US006769218B2

(12) United States Patent
Pervan

(10) Patent No.: US 6,769,218 B2
(45) Date of Patent: Aug. 3, 2004

(54) FLOORBOARD AND LOCKING SYSTEM THEREFOR

(75) Inventor: Darko Pervan, Viken (SE)

(73) Assignee: Valinge Aluminium AB, Viken (SE)

( * ) Notice: Subject to any disclaimer, the term of this patent is extended or adjusted under 35 U.S.C. 154(b) by 44 days.

(21) Appl. No.: 10/043,424

(22) Filed: Jan. 14, 2002

(65) Prior Publication Data

US 2002/0112433 A1 Aug. 22, 2002

Related U.S. Application Data

(60) Provisional application No. 60/329,519, filed on Oct. 17, 2001, and provisional application No. 60/329,499, filed on Oct. 17, 2001.

(30) Foreign Application Priority Data

Jan. 12, 2001 (SE) ..... 0100100
Jan. 12, 2001 (SE) ..... 0100101

(51) Int. Cl.[7] ..... E04B 1/38
(52) U.S. Cl. ..... 52/591.4; 52/591.1; 52/592.1
(58) Field of Search ..... 52/582.1, 582.2, 52/586.1, 591.1, 591.4, 591.5, 592.1

(56) References Cited

U.S. PATENT DOCUMENTS

| | | | |
|---|---|---|---|
| 213,740 | A | 4/1879 | Conner |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels et al. |
| 1,510,924 | A | 10/1924 | Daniels et al. |
| 1,540,128 | A | 6/1925 | Houston |
| 1,575,821 | A | 3/1926 | Daniels |

(List continued on next page.)

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CH | 200949 | | 1/1939 |
| CH | 211877 | | 1/1941 |
| CH | 690 242 | A5 | 6/2000 |
| DE | 1 212 275 | | 3/1966 |
| DE | 7102476 | | 1/1971 |
| DE | 1534278 | | 11/1971 |
| DE | 2 205 232 | | 8/1973 |
| DE | 7402354 | | 1/1974 |

(List continued on next page.)

OTHER PUBLICATIONS

Brochure for CLIC Laminate Flooring, Art.–Nr. 110 11 640.
Brochure for Laminat–Boden "Clever–Click", Parador® Wohnsysteme.

(List continued on next page.)

*Primary Examiner*—Carl D. Friedman
*Assistant Examiner*—Basil Katcheves
(74) *Attorney, Agent, or Firm*—Burns, Doane, Swecker & Mathis, L.L.P.

(57) ABSTRACT

A floorboard and an openable locking system therefor comprise an undercut groove on one long side of the floorboard and a projecting tongue on the opposite long side of the floorboard. The undercut groove has a corresponding upwardly directed inner locking surface at a distance from its tip. The tongue and the undercut groove are formed to be connected by adjoining boards being brought together and snapped together.

123 Claims, 11 Drawing Sheets

U.S. PATENT DOCUMENTS 1,602,256 A 10/1926 Sellin
1,602,267 A 10/1926 Karwisch
1,615,096 A 1/1927 Meyers
1,622,103 A 3/1927 Fulton
1,622,104 A 3/1927 Fulton
1,637,634 A 8/1927 Carter
1,644,710 A 10/1927 Crooks
1,660,480 A 2/1928 Daniels
1,714,738 A 5/1929 Smith
1,718,702 A 6/1929 Pfiester
1,734,826 A 11/1929 Pick
1,764,331 A 6/1930 Moratz
1,778,069 A 10/1930 Fetz
1,787,027 A 12/1930 Wasleff
1,823,039 A 9/1931 Gruner
1,859,667 A 5/1932 Gruner
1,898,364 A 2/1933 Gynn
1,906,411 A 5/1933 Potvin
1,929,871 A 10/1933 Jones
1,940,377 A 12/1933 Storm
1,953,306 A 4/1934 Moratz
1,986,739 A 1/1935 Mitte
1,988,201 A 1/1935 Hall
2,044,216 A 6/1936 Klages
2,276,071 A 3/1942 Scull
2,324,628 A 7/1943 Kähr
2,398,632 A 4/1946 Frost et al.
2,430,200 A 11/1947 Wilson
2,740,167 A 4/1956 Rowley
2,780,253 A 2/1957 Joa
2,894,292 A 7/1959 Gramelspacher
3,045,294 A 7/1962 Livezey, Jr.
3,100,556 A 8/1963 De Ridder
3,125,138 A 3/1964 Bolenbach
3,182,769 A 5/1965 De Ridder
3,203,149 A 8/1965 Soddy
3,267,630 A 8/1966 Omholt
3,282,010 A 11/1966 King, Jr.
3,310,919 A 3/1967 Bue et al.
3,347,048 A 10/1967 Brown et al.
3,387,422 A 6/1968 Wanzer
3,460,304 A 8/1969 Braeuninger et al.
3,481,810 A 12/1969 Waite
3,526,420 A 9/1970 Brancalcone
3,538,665 A 11/1970 Gohner
3,553,919 A 1/1971 Omholt
3,555,762 A 1/1971 Costanzo, Jr.
3,694,983 A 10/1972 Couquet
3,714,747 A 2/1973 Curran
3,731,445 A 5/1973 Hoffmann et al.
3,759,007 A 9/1973 Thiele
3,768,846 A 10/1973 Hensley et al.
3,786,608 A 1/1974 Boettcher
3,859,000 A 1/1975 Webster
3,902,293 A 9/1975 Witt et al.
3,908,053 A 9/1975 Hettich
3,936,551 A 2/1976 Elmendorf et al.
3,988,187 A 10/1976 Witt et al.
4,090,338 A 5/1978 Bourgade
4,099,358 A 7/1978 Compaan
4,169,688 A 10/1979 Toshio
4,242,390 A 12/1980 Nemeth
4,299,070 A 11/1981 Oltmanns et al.
4,426,820 A 1/1984 Terbrack et al.
4,471,012 A 9/1984 Maxwell
4,501,102 A 2/1985 Knowles
4,561,233 A 12/1985 Harter et al.
4,612,745 A 9/1986 Hovde
4,641,469 A 2/1987 Wood
4,643,237 A 2/1987 Rosa
4,653,242 A 3/1987 Ezard
4,703,597 A 11/1987 Eggemar
4,715,162 A 12/1987 Brightwell
4,738,071 A 4/1988 Ezard
4,769,963 A 9/1988 Meyerson
4,819,932 A 4/1989 Trotter, Jr.
4,831,806 A 5/1989 Niese et al.
4,845,907 A 7/1989 Meek
4,905,442 A 3/1990 Daniels
5,029,425 A 7/1991 Bogataj
5,113,632 A 5/1992 Hanson
5,117,603 A 6/1992 Weintraub
5,148,850 A 9/1992 Urbanick
5,165,816 A 11/1992 Parasin
5,179,812 A 1/1993 Hill
5,216,861 A 6/1993 Meyerson
5,253,464 A 10/1993 Nilsen
5,271,564 A 12/1993 Smith
5,295,341 A 3/1994 Kajiwara
5,349,796 A 9/1994 Meyerson
5,390,457 A 2/1995 Sjölander
5,433,806 A 7/1995 Pasquali et al.
5,474,831 A 12/1995 Nystrom
5,497,589 A 3/1996 Porter
5,502,939 A 4/1996 Zadok et al.
5,540,025 A 7/1996 Takehara et al.
5,567,497 A 10/1996 Zegler et al.
5,570,554 A 11/1996 Searer
5,597,024 A 1/1997 Bolyard et al.
5,630,304 A 5/1997 Austin
5,671,575 A 9/1997 Wu
5,695,875 A 12/1997 Larsson et al.
5,706,621 A 1/1998 Pervan
5,768,850 A 6/1998 Chen
5,797,237 A * 8/1998 Finkell, Jr. ..... 52/589.1
5,823,240 A 10/1998 Bolyard et al.
5,827,592 A 10/1998 Van Gulik et al.
5,860,267 A 1/1999 Pervan
5,900,099 A 5/1999 Sweet et al.
5,935,668 A 8/1999 Smith
5,943,239 A 8/1999 Shamblin et al.
5,968,625 A 10/1999 Hudson
5,987,839 A 11/1999 Hamar et al.
6,006,486 A 12/1999 Moriau et al.
6,023,907 A 2/2000 Pervan
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,182,410 B1 2/2001 Pervan
6,203,653 B1 3/2001 Seidner
6,205,639 B1 3/2001 Pervan
6,209,278 B1 4/2001 Tychsen
6,216,403 B1 4/2001 Belbeoc'h
6,216,409 B1 4/2001 Roy et al.
6,324,803 B1 12/2001 Pervan
6,339,908 B1 1/2002 Chuang
6,363,677 B1 4/2002 Chen et al.
6,385,936 B1 * 5/2002 Schneider ..... 52/589.1
6,421,970 B1 * 7/2002 Martensson et al. ..... 52/282.1
6,446,405 B1 9/2002 Pervan
6,490,836 B1 12/2002 Moriau et al.
6,510,665 B2 1/2003 Pervan
6,516,579 B1 2/2003 Pervan
6,532,709 B2 3/2003 Pervan
2001/0029720 A1 10/2001 Pervan
2001/0034992 A1 11/2001 Pletzer et al.
2002/0007608 A1 1/2002 Pervan
2002/0007609 A1 1/2002 Pervan
2002/0020127 A1 2/2002 Thiers et al.

| | | | |
|---|---|---|---|
| 2002/0031646 | A1 | 3/2002 | Chen et al. |
| 2002/0046528 | A1 | 4/2002 | Pervan et al. |
| 2002/0069611 | A1 | 6/2002 | Leopolder |
| 2002/0095894 | A1 | 7/2002 | Pervan |
| 2002/0178673 | A1 | 12/2002 | Pervan |
| 2002/0178674 | A1 | 12/2002 | Pervan |
| 2002/0178682 | A1 | 12/2002 | Pervan |
| 2003/0009972 | A1 | 1/2003 | Pervan et al. |
| 2003/0024199 | A1 | 2/2003 | Pervan et al. |
| 2003/0033784 | A1 | 2/2003 | Pervan |
| 2003/0084636 | A1 | 5/2003 | Pervan |

FOREIGN PATENT DOCUMENTS

| | | | |
|---|---|---|---|
| DE | 2 238 660 | | 2/1974 |
| DE | 2 252 643 | | 5/1974 |
| DE | 2502992 | | 7/1976 |
| DE | 2616077 | | 10/1977 |
| DE | 2917025 | | 11/1980 |
| DE | 30 41781 | A1 | 6/1982 |
| DE | 32 14 207 | A1 | 11/1982 |
| DE | 32 46 376 | C2 | 6/1984 |
| DE | 3343601 | A1 | 6/1985 |
| DE | 8604004 | | 6/1986 |
| DE | 3512204 | A1 | 10/1986 |
| DE | 3544845 | A1 | 6/1987 |
| DE | 36 31 390 | A1 | 12/1987 |
| DE | 40 02 547 | A1 | 8/1991 |
| DE | 4134452 | A1 | 4/1993 |
| DE | 4215273 | A1 | 11/1993 |
| DE | 4242530 | A1 | 6/1994 |
| DE | 43 13 037 | C1 | 8/1994 |
| DE | 93 17 191 | U1 | 4/1995 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 200 01 225 | U1 | 8/2000 |
| DE | 200 02 744 | U1 | 9/2000 |
| DE | 199 25 248 | A1 | 12/2000 |
| DE | 200 17 461 | U1 | 3/2001 |
| DE | 200 18 284 | U1 | 3/2001 |
| DE | 100 32 204 | C1 | 7/2001 |
| EP | 0 248 127 | A1 | 12/1987 |
| EP | 0 623 724 | A1 | 11/1994 |
| EP | 0 652 340 | A1 | 5/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 958 441 | | 11/1998 |
| EP | 0 903 451 | A2 | 3/1999 |
| EP | 0 969 163 | A2 | 1/2000 |
| EP | 0 969 163 | A3 | 1/2000 |
| EP | 0 969 164 | A3 | 1/2000 |
| EP | 0 969 164 | A2 | 1/2000 |
| EP | 0 974 713 | A1 | 1/2000 |
| EP | 1 048 423 | A2 | 11/2000 |
| EP | 1 251 219 | A1 | 7/2001 |
| EP | 1 120 515 | A1 | 8/2001 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 5/2000 |
| FR | 2 785 633 | A1 | 5/2000 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1237744 | | 6/1971 |
| GB | 1275511 | | 5/1972 |
| GB | 1430423 | | 3/1976 |
| GB | 2117813 | A | 10/1983 |
| GB | 2 126 106 | A | 3/1984 |
| GB | 2243381 | A | 10/1991 |
| GB | 2256023 | A | 11/1992 |
| JP | 54-65528 | | 5/1979 |
| JP | 51-119056 | | 7/1982 |
| JP | 59-186336 | | 11/1984 |
| JP | 3-169967 | | 7/1991 |
| JP | 4-106264 | | 4/1992 |
| JP | 4-191001 | | 7/1992 |
| JP | 5-148984 | | 6/1993 |
| JP | 6-56310 | | 5/1994 |
| JP | 6-146553 | A | 5/1994 |
| JP | 6-320510 | A | 11/1994 |
| JP | 7-076923 | A | 3/1995 |
| JP | 7-180333 | A | 7/1995 |
| JP | 7-300979 | A | 11/1995 |
| JP | 7-310426 | A | 11/1995 |
| JP | 8-109734 | | 4/1996 |
| JP | 9-38906 | | 2/1997 |
| JP | 9-88315 | | 3/1997 |
| JP | 2000-226932 | | 8/2000 |
| NL | 7601773 | | 8/1976 |
| NO | 157871 | | 7/1984 |
| NO | 305614 | | 5/1995 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | WO 97/47834 | | 12/1997 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/20705 | A1 | 4/2000 |
| WO | 00/20706 | A1 | 4/2000 |
| WO | WO 00/66856 | A1 | 11/2000 |
| WO | 01/66876 | A1 | 9/2001 |

WO WO 01/75247 A1 10/2001
WO WO 01/77461 A1 10/2001

OTHER PUBLICATIONS

Brochure for PERGO®, CLIC Laminate Flooring, and Prime Laminate Flooring from Bauhaus, The Home Store, Malmö, Sweden.

Pamphlet from Serexhe for Compact–Praxis, entitled "Selbst Teppichböden, PVC und Parkett verlegen", Published by Compact Verlag, München, Germany, 1985, pp. 84–87.

Pamphlet from Junckers Industrser A/S entitled "Bøjlesystemet til Junckers boliggulve" Oct. 1994, , Published by Junckers Industrser A/S, Denmark.

Pamphlet from Junckers Industrser A/S entitled "The Clip System for Junckers Sports Floors", Annex 7, 1994, Published by Junckers Industrser A/S, Denmark.

Pamphlet from Junckers Industrser A/S entitled "The Clip System for Junckers Domestic Floors", Annex 8, 1994, Published by Junckers Industrser A/S, Denmark.

Fibo–Trespo Alloc System Brochure entitled "Opplaering OG Autorisasjon", pp. 1–29, Fibo–Trespo.

"Revolution bei der Laminatboden–Verl", boden wand decke, vol. No. 11 of 14, Jan. 10, 1997, p. 166.

Kährs Focus Extra dated Jan. 2001, pp. 1–9.

Alloc, Inc., Berry Finance NV, and Välinge Aluminium AB v. Unilin Decor NV, BHK of America, Inc., Pergo, Inc., Meister–Leisten Schulte GmbH, Akzenta Paneele+Profile GmbH, Tarkett, Inc., and Roysol; ITC No. 337–TA–443 (Docket No. 2154) Filed Dec. 4, 2000.

Alloc, Inc., Berry Finance NV, and Välinge Aluminium AB v. Tarkett, Inc.; U.S. District Court for the Eastern District of Wisconsin; Civil Action No. 00–CV–1377.

Välinge, Fibo–Trespo Brochure, Distributed at the Domotex Fair In Hannover, Germany, Jan. 1996.

Träindustrins Handbook "Snickeriarbete", 2nd Edition, Malmö 1952, pp. 826, 827, 854, and 855, published by Teknografiska Aktiebolaget, Sweden.

"Träbearbetning", Anders Grönlund, 1986, ISBN 91–970513–2–2, pp. 357–360, published by Institutet for Trateknisk Forskning, Stockholm, Sweden.

Drawing Figure 25/6107 from Buetec Gmbh dated Dec. 16, 1985.

Communication of Notices of Intervention by E.F.P. Floor Products dated Mar. 17, 2000 in European Patent Application 0698162, pp. 1–11 with annex pp. 1–21.

Response to the E.F.P. Floor Products intervention dated Jun. 28, 2000, pp. 1–5.

Letters from the Opponent dated Jul. 26, 2001 and Jul. 30, 2001 including Annexes 1 to 3.

Communication from European Patent Office dated Sep. 20, 2001 in European Patent No. 0698162, pp. 1–2 with Facts and Submissions Annex pp. 1–18, Minutes Annex pp. 1–11, and Annex I to VI.

Communication from Swedish Patent Office dated Sep. 21, 2001 in Swedish Patent No. 9801986–2, pp. 1–3 in Swedish with forwarding letter dated Sep. 24, 2001 in English.

Pergo, Inc. v. Välinge Aluminium AB, Berry Finance NV, and Alloc, Inc.; U.S. District Court for the District of Columbia; Civil Action No. 1:00CV01618.

Alloc, Inc. v. Unilin Decor NV and BHK of America, Inc.; U.S. District Court for the Eastern District of Wisconsin; Civil Action No. 00–C–0999.

Unilin Beheer B.V., Unilin Decor, N.V., and BHK of America, Inc. v. Välinge Aluminium AB; U.S. District Court for the District of Columbia; Civil Action No. 1:00CV01823.

FI Office Action dated Mar. 19, 1998.

NO Office Action dated Dec. 22, 1997.

NO Office Action dated Sep. 21, 1998.

Opposition EP 0.877.130 B1—Facts—Arguments, dated Jun. 28, 2000, pp. 1–13.

RU Application Examiner Letter dated Sep. 26, 1997.

NZ Application Examiner Letter dated Oct. 21, 1999.

European prosecution file history to grant, European Patent No. 94915725.9–2303/0698162, grant date Sep. 16, 1998.

European prosecution file history to grant, European Patent No. 98106535.2–2303/0855482, grant date Dec. 1, 1999.

European prosecution file history to grant, European Patent No. 98201555.4–2303/0877130, grant date Jan. 26, 2000.

Webster's Dictionary, Random House: New York (1987), p. 862.

Knight's American Mechanical Dictionary, Hurd and Houghton: New York (1876), p. 2051.

Opposition EP 0.698,162 B1—Facts–Grounds–Arguments, dated Apr. 1, 1999, pp. 1–56.

Opposition II EP 0.698,162 B1—Facts–Grounds–Arguments, dated Apr. 30, 1999, (17 pages)—with translation (11 pages).

Opposition I: Unilin Decor N.V./Välinge Aluminum AB, communication dated Jun. 8, 1999 to European Patent Office, pp. 1–2.

Opposition I: Unilin Decor N.V./Välinge Aluminum AB, communication dated Jun. 16, 1999 to European Patent Office, pp. 1–2.

Darko Pervan et al., U.S. Patent Application No. 10/205,395 entitled "*Floor Panel with Sealing Means*" filed Jul. 26, 2002.

Darko Pervan et al., U.S. Patent Application No. 10/235,940 entitled "*Flooring and Method for Laying and Manufacturing the Same*" filed Sep. 6, 2002.

Darko Pervan U.S. Patent Application No. 10/256,167 entitled "*Locking System for Mechanical Joining of Floorboards and Method for Production Thereof*" filed Sep. 27, 2002.

Tony Pervan, U.S. Patent Application No. 09/534,007 entitled "*System for Joining Building Boards*" filed Mar. 24, 2000.

Darko Pervan, U.S. Patent Application No. 09/679,300 entitled "*Locking System and Flooring Board*" filed Oct. 6, 2000.

Darko Pervan, U.S. Patent Application No. 09/714,514 entitled "*Locking System and Flooring Board*" filed Nov. 17, 2000.

Darko Pervan, U.S. Patent Application No. 10/043,149 entitled "*Floorboards And Methods For Production And Installation Thereof*" filed Jan. 14, 2002.

Darko Pervan, U.S. Patent Application No. 10/100,032 entitled "*Locking System and Flooring Board*" filed Mar. 19, 2002.

Darko Pervan, U.S. Patent Application No. 10/359,615 entitled "Locking System for Floorboards" filed Feb. 7, 2003.

Darko Pervan, U.S. Patent Application No. 10/361,815 entitled "Locking System and Flooring Board" filed Feb. 11, 2003.

Darko Pervan, U.S. Patent Application No. 10/413,478 entitled "Mechanical Locking System for Floating Floor" filed Apr. 15, 2003.

Darko Pervan, U.S. Patent Application No. 10/413,479 entitled "Floorboards for Floating Floor" filed Apr. 15, 2003.

Darko Pervan, U.S. Patent Application No. 10/413,566 entitled "Floorboards with Decorative Grooves" filed Apr. 15, 2003.

Tony Pervan, U.S. Patent Application No. 10/430,273 entitled "System for Joining Building Panels" filed May 7, 2003.

* cited by examiner

KÄND TEKNIK

KÄND TEKNIK

KÄND TEKNIK

Fig. 4a
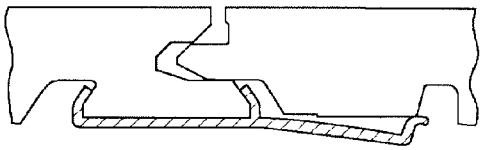
Fig. 4b
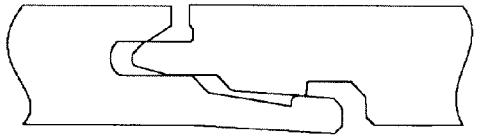
Fig. 5a
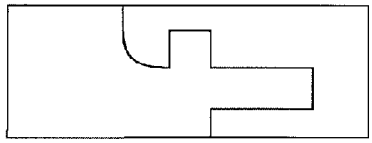
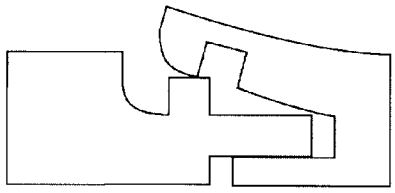
Fig. 5b
Fig. 6a
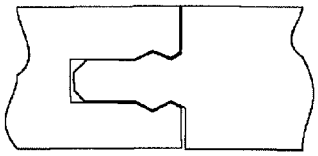
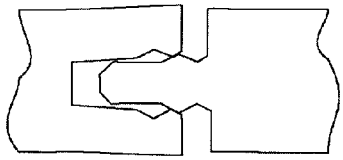
Fig. 6b
Fig. 7a
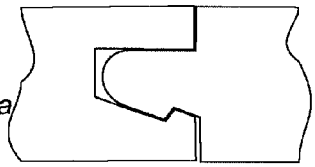
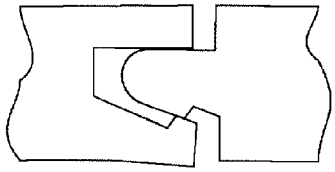
Fig. 7b
Fig. 8a
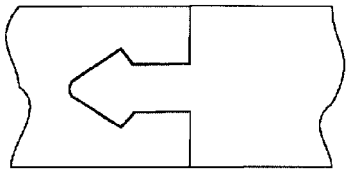
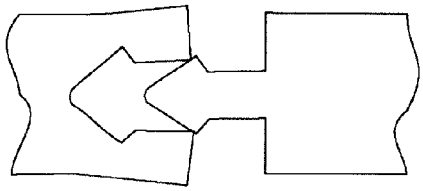
Fig. 8b
Fig. 9a
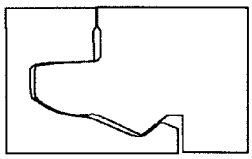
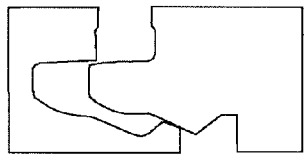
Fig. 9b
Fig. 10a
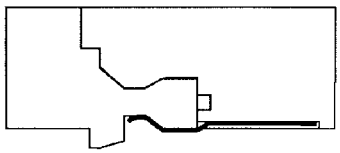
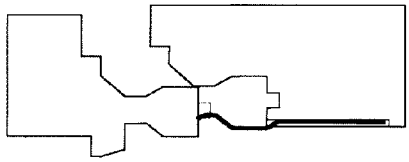
Fig. 10b
KÄND TEKNIK 30
32
38
36
34

5b
30b
1
4a
4b
30c
5a 36
30b
32
30a
34
30c
38

Snitt C1-C1

Snitt C3-C4

FLOORBOARD AND LOCKING SYSTEM THEREFOR

This application claims priority under 35 U.S.C. §§119 and/or 365 to 0100101-5 filed in Sweden on Jan. 12, 2001; 0100100-7 filed in Sweden on Jan. 12, 2001; U.S. Provisional Application No. 60/329,519 filed on Oct. 17, 2001 and to U.S. Provisional Application No. 60/329,499 filed on Oct. 17, 2001 the entire contents of all four applications are hereby incorporated herein by reference.

The present invention relates to a locking system for mechanical joining of floorboards and floorboards having such a locking system.

TECHNICAL FIELD

The invention is particularly suited for floorboards which are based on wood material and in the normal case have a core of wood and which are intended to be mechanically joined. The following description of prior-art technique and the objects and features of the invention will therefore be directed at this field of application and, above all, rectangular parquet floors which are joined on long side as well as short side. The invention is particularly suited for floating floors, i.e. floors that can move in relation to the base. However, it should be emphasized that the invention can be used on all types of existing hard floors, such as homogeneous wooden floors, wooden floors with a lamellar core or plywood core, floors with a surface of veneer and a core of wood fiber, thin laminate floors, floors with a plastic core and the like. The invention can, of course, also be used in other types of floorboards which can be machined with cutting tools, such as subfloors of plywood or particle board. Even if it is not preferred, the floorboards can after installation be fixed to the base.

TECHNICAL BACKGROUND OF THE INVENTION

Mechanical joints have in a short time taken great market shares mainly owing to their superior laying properties, joint strength and joint quality. Even if the floor according to WO 9426999 as described in more detail below and the floor marketed under the trademark Alloc© have great advantages compared with traditional, glued floors, further improvements are, however, desirable.

Mechanical joint systems are very convenient for joining not only of laminate floors but also wooden floors and composite floors. Such floorboards may consist of a large number of different materials in the surface, core and rear side. As will be described below, these materials can also be included in the different parts of the joint system, such as strip, locking element and tongue. A solution involving an integrated strip which is formed according to, for example, WO 9426999 or WO 9747834 and which provides the horizontal joint, and also involving a tongue which provides the vertical joint, results, however, in costs in the form of material waste in connection with the forming of the mechanical joint by machining of the board material.

For optimal function, for instance a 15-mm-thick parquet floor should have a strip which is of a width which is approximately the same as the thickness of the floor, i.e. about 15 mm. With a tongue of about 3 mm, the amount of waste will be 18 mm. The floorboard has a normal width of about 200 mm. Therefore the amount of material waste will be about 9%. In general, the cost of material waste will be great if the floorboards consist of expensive materials, if they are thick or if their format is small, so that the number of running meters of joint per square meter of floor will be great.

Certainly the amount of material waste can be reduced if a strip is used which is in the form of a separately manufactured aluminum strip which is already fixed to the floorboard at the factory. Moreover, the aluminum strip can in a number of applications result in a better and also more inexpensive joint system than a strip machined and formed from the core. However, the aluminum strip is disadvantageous since the investment cost can be considerable and extensive reconstruction of the factory may be necessary to convert an existing traditional production line so that floorboards with such a mechanical joint system can be produced. An advantage of the prior-art aluminum strip is, however, that the starting format of the floorboards need not be changed.

When a strip produced by machining of the floorboard material is involved, the reverse is the case. Thus, the format of the floorboards must be adjusted so that there is enough material for forming the strip and the tongue. For laminate floors, it is often necessary to change also the width of the decorative paper used. All these adjustments and changes also require costly modifications of production equipment and great product adaptations.

In addition to the above problems relating to undesirable material waste and costs of production and product adaptation, the strip has disadvantages in the form of its being sensitive to damage during transport and installation.

To sum up, there is a great need of providing a mechanical joint at a lower production cost while at the same time the aim is to maintain the present excellent properties as regards laying, taking-up, joint quality and strength. With prior-art solutions, it is not possible to obtain a low cost without also having to lower the standards of strength and/or laying function. An object of the invention therefore is to indicate solutions which aim at reducing the cost while at the same time strength and function are retained.

The invention starts from known floorboards which have a core, a front side, a rear side and opposite joint edge portions, of which one is formed as a tongue groove defined by upper and lower lips and having a bottom end, and the other is formed as a tongue with an upwardly directed portion at its free outer end. The tongue groove has the shape of an undercut groove with an opening, an inner portion and an inner locking surface. At least parts of the lower lip are formed integrally with the core of the floorboard and the tongue has a locking surface which is designed to coact with the inner locking surface in the tongue groove of an adjoining floorboard, when two such floorboards are mechanically joined, so that their front sides are located in the same surface plane (HP) and meet at a joint plane (VP) directed perpendicular thereto. This technique is disclosed in, inter alia WO 9227721, DE-A-1211175 and JP 3169967, which will be discussed in more detail below.

Before that, however, the general technique regarding floorboards and locking systems for mechanical locking-together of floorboards will be described as a background of the present invention.

DESCRIPTION OF PRIOR ART

To facilitate the understanding and description of the present invention as well as the knowledge of the problems behind the invention, here follows a description of both the basic construction and the function of floorboards according to WO 9426999 and WO 9966151, with reference to FIGS. 1–10 in the accompanying drawings. In applicable parts, the following description of the prior-art technique also applies to the embodiments of the present invention as described below.

FIGS. 3*a* and 3*b* show a floorboard 1 according to WO 9426999 from above and from below, respectively. The board 1 is rectangular with an upper side 2, an underside 3, two opposite long sides with joint edge portions 4*a* and 4*b*, and two opposite short sides with joint edge portions 5*a* and 5*b*.

The joint edge portions 4*a*, 4*b* of the long sides as well as the joint edge portions 5*a*, 5*b* of the short sides can be joined mechanically without glue in a direction D2 in FIG. 1*c*, so as to meet in a joint plane VP (marked in FIG. 2*c*) and so as to have, in their laid state, their upper sides in a common surface plane HP (marked in FIG. 2*c*).

In the shown embodiment, which is an example of floorboards according to WO 9426999 (FIGS. 1–3 in the accompanying drawings), the board 1 has a factory-mounted plane strip 6 which extends along the entire long side 4*a* and which is made of a flexible, resilient aluminum sheet. The strip 6 extends outwards beyond the joint plane VP at the joint edge portion 4*a*. The strip 6 can be attached mechanically according to the shown embodiment or else by glue or in some other manner. As stated in said documents, it is possible to use as material for a strip that is attached to the floorboard at the factory, also other strip materials, such as sheet of some other metal, aluminum or plastic sections. As is also stated in WO 9426999 and as described and shown in WO 9966151, the strip 6 can instead be formed integrally with the board 1, for instance by suitable machining of the core of the board 1.

The present invention is usable for floorboards where the strip or at least part thereof is integrally formed with the core, and the invention solves special problems that exist in the joining, disconnection and production of such floorboards. The core of the floorboard need not, but is preferably, made of a uniform material. The strip, however, is always integrated with the board, i.e. it should be formed on the board or be factory-mounted.

In known embodiments according to the above-mentioned WO 9426999 and WO 9966151, the width of the strip 6 can be about 30 mm and the thickness about 0.5 mm.

A similar, although shorter strip 6' is arranged along one short side 5*a* of the board 1. The part of the strip 6 projecting beyond the joint plane VP is formed with a locking element 8 which extends along the entire strip 6. The locking element 8 has in its lower part an operative locking surface 10 facing the joint plane VP and having a height of, for instance, 0.5 mm. In laying, this locking surface 10 coacts with a locking groove 14 which is made in the underside 3 of the joint edge portion 4*b* of the opposite long side of an adjoining board 1'. The strip 6' along the short side is provided with a corresponding locking element 8', and the joint edge portion 5*b* of the opposite short side has a corresponding locking groove 14'. The edge of the locking grooves 14, 14' facing away from the joint plane VP forms an operative locking surface 10' for coaction with the operative locking surface 10 of the locking element.

For mechanical joining of long sides as well as short sides also in the vertical direction (direction D1 FIG. 1*c*), the board 1 is also along its one long side (joint edge portion 4*a*) and its one short side (joint edge portion 5*a*) formed with a laterally open recess or tongue groove 16. This is defined upwards by an upper lip at the joint edge portion 4*a*, 5*a* and downwards by the respective strips 6, 6'. At the opposite edge portions 4*b*, 5*b*, there is an upper recess 18 which defines a locking tongue 20 coacting with the recess or tongue groove 16 (see FIG. 2*a*).

FIGS. 1*a*–1*c* show how two long sides 4*a*, 4*b* of two such boards 1, 1' on a base U can be joined with each other by downward angling by pivoting about a center C close to the intersection between the surface plane HP and the joint plane VP, while the boards are held essentially in contact with each other.

FIGS. 2*a*–2*c* show how the short sides 5*a*, 5*b* of the boards 1, 1' can be joined together by snap action. The long sides 4*a*, 4*b* can be joined by means of both methods, whereas the joining of the short sides 5*a*, 5*b*—after laying of the first row of floorboards—is normally carried out merely by snap action after the long sides 4*a*, 4*b* have first been joined.

When a new board 1' and a previously laid board 1 are to be joined along their long side edge portions 4*a*, 4*b* according to FIGS. 1*a*–1*c*, the long side edge portion 4*b* of the new board 1' is pressed against the long side edge portion 4*a* of the previously laid board 1 according to FIG. 1*a*, so that the locking tongue 20 is inserted into the recess or tongue groove 16. The board 1' is then angled down towards the subfloor U according to FIG. 1*b*. The locking tongue 20 enters completely the recess or tongue groove 16 while at the same time the locking element 8 of the strip 6 snaps into the locking groove 14. During this downward angling, the upper part 9 of the locking element 8 can be operative and perform guiding of the new board 1' towards the previously laid board 1.

In their joined position according to FIG. 1*c*, the boards 1, 1' are certainly locked in the D1 direction as well as the D2 direction along their long side edge portions 4*a*, 4*b*, but the boards 1, 1' can be displaced relative to each other in the longitudinal direction of the joint along the long sides (i.e. direction D3).

FIGS. 2*a*–2*c* show how the short side edge portions 5*a* and 5*b* of the boards 1, 1' can be joined mechanically in the D1 as well as the D2 direction by the new board 1' being displaced essentially horizontally towards the previously laid board 1. This can in particular be carried out after the long side of the new board 1' has been joined, by inward angling according to FIGS. 1*a*–*c*, with a previously laid board 1 in an adjoining row. In the first step in FIG. 2*a*, beveled surfaces of the recess 16 and the locking tongue 20 cooperate so that the strip 6' is forced downwards as a direct consequence of the bringing-together of the short side edge portions 5*a*, 5*b*. During the final bringing-together, the strip 6' snaps up when the locking element 8' enters the locking groove 14', so that the operative locking surfaces 10, 10' on the locking element 8' and in the locking groove 14' engage each other.

By repeating the operations shown in FIGS. 1*a*–*c* and 2*a*–*c*, the entire floor can be laid without glue and along all joint edges. Thus, prior-art floorboards of the above type can be joined mechanically by first, as a rule, being angled downwards on the long side and by the short sides, when the long side has been locked, being snapped together by horizontal displacement of the new board 1' along the long side of the previously laid board 1 (direction D3). The boards 1, 1' can, without the joint being damaged, be taken up again in reverse order of laying and then be laid once more. Parts of these laying principles are applicable also in connection with the present invention.

To function optimally and to allow easy laying and taking-up again, the prior-art boards should, after being joined, along their long sides be able to take a position where there is a possibility of a minor play between the operative locking surface 10 of the locking element and the operative locking surface 10' of the locking groove 14. However, no play is necessary in the actual butt joint between the boards in the joint plane VP close to the upper side of the boards (i.e. in the surface plane HP). For such a position to be taken, it may be necessary to press one board against the other. A more detailed description of this play is to be found in WO 9426999. Such a play can be in the order of 0.01–0.05 mm between the operative locking surfaces 10, 10' when pressing the long sides of adjoining boards against each other. This play facilitates entering of the locking element 8 in the locking groove 14, 14' and its leaving the same. As mentioned, however, no play is required in the joint between the boards, where the surface plane HP and the joint plane VP intersect at the upper side of the floorboards.

The joint system enables displacement along the joint edge in the locked position after joining of an optional side. Therefore laying can take place in many different ways which are all variants of the three basic methods:

Angling of long side and snapping in of short side.

Snapping in of long side—snapping in of short side.

Angling of short side, upward angling of two boards, displacement of the new board along the short side edge of the previous board and, finally, downward angling of two boards.

The most common and safest laying method is that the long side is first angled downwards and locked against another floorboard. Subsequently, a displacement in the locked position takes place towards the short side of a third floorboard, so that the snapping-in of the short side can take place. Laying can also be made by one side, long side or short side, being snapped together with another board. Then a displacement in the locked position takes place until the other side snaps together with a third board. These two methods require snapping-in of at least one side. However, laying can also take place without snap action. The third alternative is that the short side of a first board is angled inwards first towards the short side of a second board, which is already joined on its long side with a third board. After this joining-together, the first and the second board are slightly angled upwards. The first board is displaced in the upwardly angled position along its short side until the upper joint edges of the first and the third board are in contact with each other, after which the two boards are jointly angled downwards.

The above-described floorboard and its locking system have been very successful on the market in connection with laminate floors which have a thickness of about 7 mm and an aluminum strip 6 having a thickness of about 0.6 mm. Similarly, commercial variants of the floorboards according to WO 9966151 shown in FIGS. 4*a* and 4*b* have been successful. However, it has been found that this technique is not particularly suited for floorboards that are made of wood-fiber-based material, especially massive wood material or glued laminated wood material, to form parquet floors. One reason why this known technique is not suited for this type of products is the large amount of material waste that arises owing to the machining of the edge portions to form a tongue groove having the necessary depth.

One more known design of mechanical locking systems for boards is shown in GB-A-1430429 and FIGS. 5*a*–5*b* in the accompanying drawings. This system is basically a tongue-and-groove joint which is provided with an extra holding hook on an extended lip on one side of the tongue groove and which has a corresponding holding ridge formed on the upper side of the tongue. The system requires considerable elasticity of the lip provided with the hook, and dismounting cannot take place without destroying the joint edges of the boards. A tight fit makes manufacture difficult and the geometry of the joint causes a large amount of material waste.

WO 9747834 discloses floorboards with different types of mechanical locking systems. The locking systems which are intended for locking together the long sides of the boards (FIGS. 2–4, 11 and 22–25 in the document) are designed so as to be mounted and dismounted by a connecting and angling movement, while most of those intended for locking together the short sides of the boards (FIGS. 5–10) are designed so as to be connected to each other by being translatorily pushed towards each other for connection by means of a snap lock, but these locking systems at the short sides of the boards cannot be dismounted without being destroyed or, in any case, damaged.

Some of the boards that are disclosed in WO 9747834 and that have been designed for connection and dismounting either by an angular motion or by snapping together (FIGS. 2–4 in WO 9747834 and FIGS. 14*a*–*c* in the accompanying drawings), have at their one edge a groove and a strip projecting below the groove and extending beyond a joint plane where the upper sides of two joined boards meet. The strip is designed to coact with an essentially complementarily formed portion on the opposite edge of the board, so that two similar boards can be joined. A common feature of these floorboards is that the upper side of the tongue of the boards and the corresponding upper boundary surface of the groove are plane and parallel with the upper side or surface of the floorboards. The connection of the boards to prevent them from being pulled apart transversely of the joint plane is obtained exclusively by means of locking surfaces on the one hand on the underside of the tongue and, on the other hand, on the upper side of the lower lip or strip below the groove. These locking systems also suffer from the drawback that they require a strip portion which extends beyond the joint plane, which causes material waste also within the joint edge portion where the groove is formed.

For mechanical joining of different types of boards, in particular floorboards, there are many suggestions, in which the amount of material waste is small and in which production can take place in an efficient manner also when using wood-fiber- and wood-based board materials. Thus, WO 9227721 (FIGS. 5*a*–*b* in the accompanying drawings) and JP 3169967 (FIGS. 7*a*–*b* in the accompanying drawings) disclose two types of snap joints which produce a small amount of waste but which have the drawback that they do not allow easy dismounting of the floorboards. Moreover, in these systems it is not possible to use high locking angles so as to reduce the risk of pulling apart. Also the joint geometry is disadvantageous with regard to snapping-in, which requires a considerable degree of material deformation, and with regard to manufacturing tolerances where large surface portions must be accurately adjusted to each other. These large surface portions which are in contact with each other also make a displacement of the floorboards relative to each other in the locked position difficult.

Another known system is disclosed in DE-A-1211175 and shown in FIGS. 8*a*–*b* in the accompanying drawings. This known system is suited for sports floors of plastic material and cannot be manufactured by means of large disk-shaped cutting tools for forming the sharply undercut groove. Also this known system cannot be dismounted without the material having so great elasticity that the upper and lower lips round the undercut groove can be greatly deformed while being pulled apart. This type of joint is therefore not suited for floorboards that are based on wood-fiber-based material, if high-quality joints are desired.

FR-A-2675174 discloses a mechanical joint system for ceramic tiles which have complementarily formed opposite edge portions, in which case use is made of separate spring clips which are mounted at a distance from each other and which are formed to grasp a bead on the edge portion of an adjoining tile. The joint system is not designed for dismounting by pivoting, which is obvious from FIG. 10*a* and, in particular, FIG. 10*b* in the accompanying drawings.

As is evident from that stated above, prior-art systems have both drawbacks and advantages. However, no locking system is quite suited for rational production of floorboards with a locking system which is optimal as regards production technique, waste of material, laying and taking-up function and which besides can be used for floors which are to have high quality, strength and function in their laid state.

An object of the present invention is to satisfy this need and provide such an optimal locking system for floorboards and such optimal floorboards. Another object of the invention is to provide a snap joint which can be produced in a rational manner. Further objects of the invention are evident from that stated above as well as from the following description.

SUMMARY OF THE INVENTION

A floorboard and an openable locking system therefor comprise an undercut groove on one long side of the floorboard and a projecting tongue on the opposite long side of the floorboard. The undercut groove has a corresponding upwardly directed inner locking surface at a distance from its tip. The tongue and the undercut groove are formed to be brought together by snap action. Preferred embodiments are also dismountable by an angling motion which has its center close to the intersection between the surface planes and the common joint plane of two adjoining floorboards. The undercut in the tongue groove of such a locking system can be produced by means of disk-shaped cutting tools whose rotary shafts are inclined relative to each other to form first an inner part of the undercut portion of the groove and then a locking surface positioned closer to the opening of the groove.

What characterizes the locking system, the floorboard, and the laying method according to the invention is, however, stated in the independent claims. The dependent claims define particularly preferred embodiments according to the invention. Further advantages and features of the invention are also evident from the following description.

Before specific and preferred embodiments of the invention will be described with reference to the accompanying drawings, the basic concept of the invention and the strength and function requirements will be described.

The invention is applicable to rectangular floorboards having a first pair of parallel sides and a second pair of parallel sides. With a view to simplifying the description, the first pair is below referred to as long sides and the second pair as short sides. It should, however, be pointed that the invention is also applicable to boards that can be square.

High Joint Quality

By high joint quality is meant a tight fit in the locked position between the floorboards both vertically and horizontally. It should be possible to join the floorboards without very large visible gaps or differences in level between the joint edges in the unloaded as well as in the normally loaded state. In a high-quality floor, joint gaps and differences in level should not be greater than 0.2 and 0.1 mm respectively.

Upward Angling about Joint Edge

In general, it should be possible to angle the long side of a floorboard upwards so that the floorboards can be released. Since the boards in the starting position are joined with tight joint edges, this upward angling must thus also be able to take place with upper joint edges in contact with each other and with rotation at the joint edge. This possibility of upward angling is very important not only when changing floorboards or moving a floor. Many floorboards are trial-laid or laid incorrectly adjacent to doors, in corners etc. during installation. It is a serious drawback if the floorboard cannot be easily released without the joint system being damaged. Nor is it always the case that a board that can be angled inwards can also be angled up again. In connection with the downward angling, a slight downwards bending of the strip usually takes place, so that the locking element is bent backwards and downwards and opens. If the joint system is not formed with suitable angles and radii, the board can after laying be locked in such manner that taking-up is not possible. The short side can, after the joint of the long side has been opened by upward angling, usually be pulled out along the joint edge, but it is advantageous if also the short side can be opened by upward angling. This is particularly advantageous when the boards are long, for instance 2.4 m, which makes pulling out of short sides difficult. The upward angling should take place with great safety without the boards getting stuck and pinching each other so as to cause a risk of the locking system being damaged.

Snapping-In

It should possible to lock the short sides of floorboards by horizontal snapping-in. This requires that parts of the joint system be flexible and bendable. Even if inward angling of long sides is much easier and quicker than snapping-in, it is an advantage if also the long side can be snapped in, since certain laying operations, for instance round doors, require that the boards be joined horizontally. In case of a snappable joint, there is a risk of edge rising at the joint if the joint geometry is inappropriate.

Cost of Material at Long and Short Side

If the floorboard is, for instance, 1.2*0.2 m, each square meter of floor surface will have about six times more long side joints than short side joints. A large amount of material waste and expensive joint materials are therefore of less importance on short side than on long side.

Horizontal Strength

For high strength to be achieved, the locking element must as a rule have a high locking angle, so that the locking element does not snap out. The locking element must be high and wide so that it does not break when subjected to high tensile load as the floor shrinks in winter owing to the low relative humidity at this time of the year. This also applies to the material closest to the locking groove in the other board. The short side joint should have higher strength than the long side joint since the tensile load during shrinking in winter is distributed over a shorter joint length along the short side than along the long side.

Vertical Strength

It should be possible to keep the boards plane when subjected to vertical loads. Moreover, motion in the joint should be avoided since surfaces that are subjected to pressure and that move relative to each other, for instance upper joint edges, may cause creaking.

Displaceability

To make it possible to lock all four sides, it must be possible for a newly laid board to be displaced in the locked position along a previously laid board. This should take place using a reasonable amount of force, for instance by driving together using a block and hammer, without the joint edges being damaged and without the joint system having to be formed with visible play horizontally and vertically. Displaceability is more important on long side than on short side since the friction is there essentially greater owing to a longer joint.

Production

It should be possible to produce the joint system rationally using large rotating cutting tools having extremely good accuracy and capacity.

Measuring

A good function, production tolerance and quality require that the joint profile can be continuously measured and checked. The critical parts in a mechanical joint system should be designed in such manner that production and measurement are facilitated. It should be possible to produce them with tolerances of a few hundredths of a millimeter, and it should therefore be possible to measure them with great accuracy, for instance in a so-called profile projector. If the joint system is produced with linear cutting machining, the joint system will, except for certain production tolerances, have the same profile over the entire edge portion. Therefore the joint system can be measured with great accuracy by cutting out some samples by sawing from the floorboards and measuring them in the profile projector or a measuring microscope. Rational production, however, requires that the joint system can also be measured quickly and easily without destructive methods, for instance using gages. This is facilitated if the critical parts in the locking system are as few as possible.

Optimization of Long and Short Side

For a floorboard to be manufactured optimally at a minimum cost, long and short side should be optimized in view of their different properties as stated above. For instance, the long side should be optimized for downward angling, upward angling, positioning and displaceability, while the short side should be optimized for snapping-in and high strength. An optimally designed floorboard should thus have different joint systems on long and short side.

Possibility of Moving Transversely of Joint Edge

Wood-based floorboards and floorboards in general which contain wood fiber swell and shrink as the relative humidity changes. Swelling and shrinking usually start from above, and the surface layers can therefore move to a greater extent than the core, i.e. the part of which the joint system is formed. To prevent the upper joint edges from rising or being crushed in case of a high degree of swelling, or joint gaps from arising when drying up, the joint system should be constructed so as to allow motion that compensates for swelling and shrinking.

The Invention

The invention is based on a first understanding that by using suitable production methods, essentially by machining and using tools whose tool diameter significantly exceeds the thickness of the board, it is possible to form advanced shapes rationally with great accuracy of wood materials, wood-based boards and plastic materials, and that this type of machining can be made in a tongue groove at a distance from the joint plane. Thus, the shape of the joint system should be adapted to rational production which should be able to take place with very narrow tolerances. Such an adaptation, however, is not allowed to take place at the expense of other important properties of the floorboard and the locking system.

The invention is also based on a second understanding, which is based on the knowledge of the requirements that must be satisfied by a mechanical joint system for optimal function. This understanding has made it possible to satisfy these requirements in a manner that has previously not been known, viz. by a combination of a) the design of the joint system with, for instance, specific angles, radii, play, free surfaces and ratios between the different parts of the system, and b) optimal utilization of the material properties of the core or core, such as compression, elongation, bending, tensile strength and compressive strength.

The invention is further based on a third understanding that it is possible to provide a joint system at a lower production cost while at the same time function and strength can be retained or even, in some cases, be improved by a combination of manufacturing technique, joint design, choice of materials and optimization of long and short sides.

The invention is based on a fourth understanding that the joint system, the manufacturing technique and the measuring technique must be developed and adjusted so that the critical parts requiring narrow tolerances should, to the greatest possible extent, be as few as possible and also be designed so as to allow measuring and checking in continuous production.

According to a first aspect of the invention, there are thus provided a locking system and a floorboard with such a locking system for mechanical joining of all four sides of this floorboard in a first vertical direction D1, a second horizontal direction D2 and a third direction D3 perpendicular to the second horizontal direction, with corresponding sides of other floorboards with identical locking systems.

The floorboards can on two sides have a disconnectible mechanical joint system, which is of a known type and which can be laterally displaced in the locked position and locked by inward angling about joint edges or by horizontal snapping. The floorboards have, on the other two sides, a locking system according to the invention. The floorboards can also have a locking system according to the invention on all four sides.

At least two opposite sides of the floorboard thus have a joint system which is designed according to the invention and which comprises a tongue and a tongue groove defined by upper and lower lips, where the tongue in its outer and upper part has an upwardly directed part and where the tongue groove in its inner and upper part has an undercut. The upwardly directed part of the tongue and the undercut of the tongue groove in the upper lip have locking surfaces that counteract and prevent horizontal separation in a direction D2 transversely of the joint plane. The tongue and the tongue groove also have coacting supporting surfaces which prevent vertical separation in a direction D1 parallel with the joint plane. Such supporting surfaces are to be found at least in the bottom part of the tongue and on the lower lip of the tongue groove. In the upper part, the coacting locking surfaces can serve as upper supporting surfaces, but the upper lip of the tongue groove and the tongue can advantageously also have separate upper supporting surfaces. The tongue, the tongue groove, the locking element and the undercut are designed so that they can be manufactured by machining using tools which have a greater tool diameter than the thickness of the floorboard. The tongue can with its upwardly directed portion be inserted into the tongue groove and its undercut by essentially horizontal snapping-in, the lower lip being bent so that the upwardly directed portion of the tongue can be inserted into the undercut. The lower lip is shorter than the upper lip, which facilitates the possibility of forming an undercut with a locking surface which has a relatively high inclination to the surface plane of the board and which thus gives a high horizontal locking force, which can be combined with a flexible lower lip.

According to a second aspect of the invention, the floorboard has two edge portions with a joint system according to the invention, where the tongue with its upwardly directed portion both can be inserted into the tongue groove and its undercut by a snap function and can leave the tongue groove by upward angling while at the same time the boards are kept in contact with each other with their upper joint edges.

Alternatively or furthermore, the tongue can be made flexible to facilitate such snapping-in at the short side after the long sides of the floorboard have been joined. Thus, the invention also relates to a snap joint which can be released by upward angling with upper joint edges in contact with each other.

According to a third aspect of the invention, the floorboard has two edge portions with a joint system which is formed according to the invention, where the tongue, while the board is held in an upwardly angled position, can be snapped into the tongue groove and then be angled down by a pivoting motion about the upper joint edge.

The lower lip is shorter than the upper lip so as to enable greater degrees of freedom when designing the undercut of the upper lip and especially its locking surface.

A plurality of aspects of the invention are also applicable to the known systems without these aspects being combined with the preferred locking systems described here.

The invention also describes the basic principles that should be satisfied for a tongue and groove joint which is to be snapped in with a minimum bending of joint components and with the surface planes of the floorboards on essentially the same level.

The invention also describes how material properties can be used to achieve high strength and low cost in combination with snapping.

Different aspects of the invention will now be described in more detail with reference to the accompanying drawings which show different embodiments of the invention. The parts of the inventive board that are equivalent to those of the prior-art board in FIGS. 1–2 have throughout been given the same reference numerals.

BRIEF DESCRIPTION OF THE DRAWINGS

FIGS. 4*a–b* show two different embodiments of floorboards according to WO 9966151.

FIGS. 5*a–b* show floorboards according to DE-A-3343601.

FIGS. 6*a–d* show mechanical locking systems for the long side or the short side of floorboards according to CA-A-0991373.

FIGS. 7*a–b* show a mechanical locking system according to GB-A-1430429.

FIGS. 8*a–b* show boards according to DE-A-4242530.

FIGS. 9*a–b* show a snap joint according to WO 9227721.

FIGS. 10*a–b* show a snap joint according to JP 3169967.

FIGS. 17*a–c* show how the joint system should be designed to facilitate snapping-in.

FIG. 19 shows locking of short side with snapping-in.

DETAILED DESCRIPTION OF PREFERRED EMBODIMENTS

A first preferred embodiment of a floorboard 1, 1', which is provided with a mechanical locking system according to the invention, will now be described with reference to FIGS. 11*a* and 11*b*. To facilitate the understanding, the joint system is shown schematically. It should be emphasized that a better function can be achieved with other preferred embodiments that will be described below.

Figure 11A:
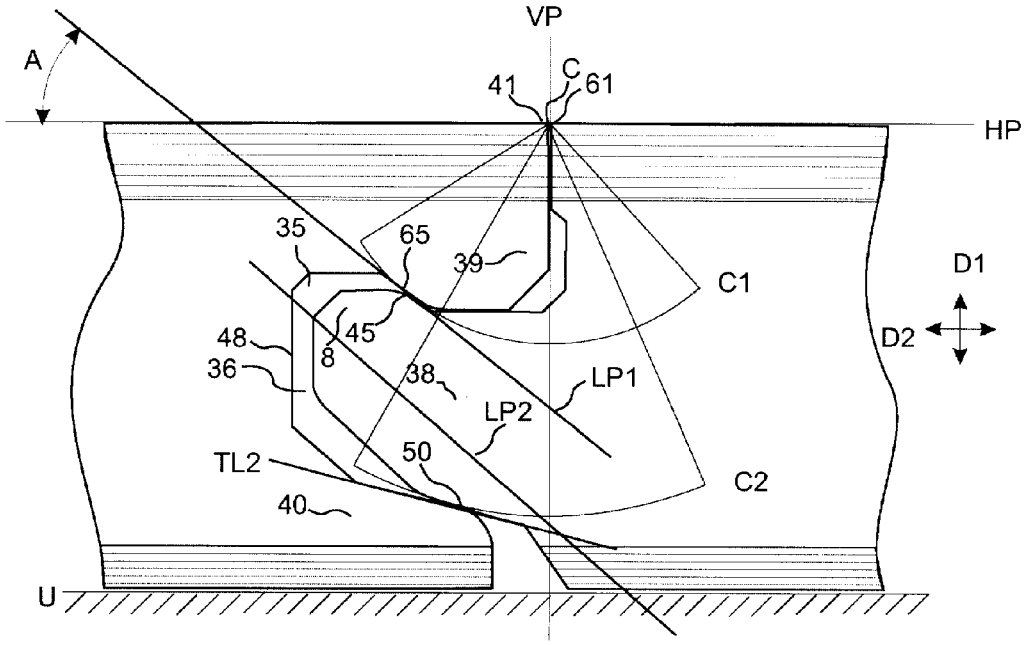
FIGS. 11*a–b* schematically illustrate two parallel joint edge portions of a first preferred embodiment of a floorboard according to the present invention.
Figure 11B:
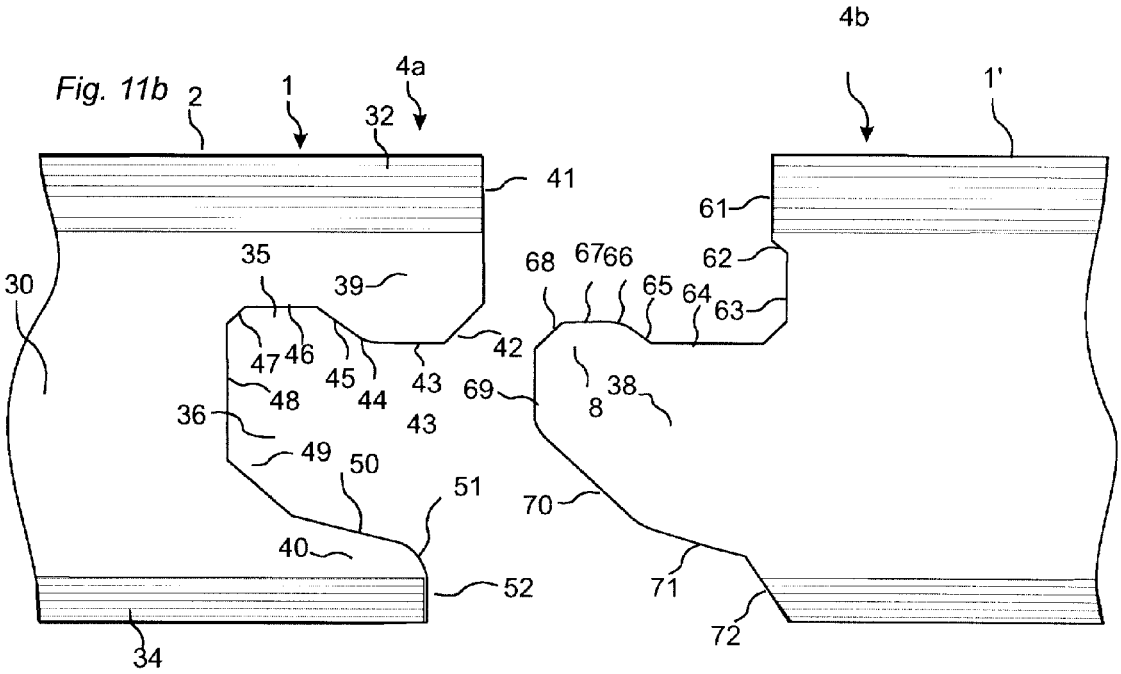

FIGS. 11*a*, 11*b* show schematically a section through a joint between a long side edge portion 4*a* of a board 1 and an opposite long side edge portion 4*b* of another board 1'.

The upper sides of the boards are essentially positioned in a common surface plane HP and the upper parts of the joint edge portions 4*a*, 4*b* engage each other in a vertical joint plane VP. The mechanical locking system results in locking of the boards relative to each other in both the vertical direction D1 and the horizontal direction D2 which extends perpendicular to the joint plane VP. During the laying of a floor with juxtaposed rows of boards, one board (1'), however, can be displaced along the other board (1) in a direction D3 (see FIG. 19) along the joint plane VP. Such a displacement can be used, for instance, to provide locking-together of floorboards that are positioned in the same row.

To provide joining of the two joint edge portions perpendicular to the vertical plane VP and parallel with the horizontal plane HP, the edges of the floorboard have in a manner known per se a tongue groove 36 in one edge portion 4*a* of the floorboard inside the joint plane VP, and a tongue 38 formed in the other joint edge portion 4*b* and projecting beyond the joint plane VP.

In this embodiment the board 1 has a core or core 30 of wood which supports a surface layer of wood 32 on its front side and a balancing layer 34 on its rear side. The board 1 is rectangular and has a second mechanical locking system also on the two parallel short sides. In some embodiments, this second locking system can have the same design as the locking system of the long sides, but the locking system on the short sides can also be of a different design according to the invention or be a previously known mechanical locking system.

As an illustrative, non-limiting example, the floorboard can be of parquet type with a thickness of 15 mm, a length of 2.4 m and a width of 0.2 m. The invention, however, can also be used for parquet squares or boards of a different size.

The core 30 can be of lamella type and consist of narrow wooden blocks of an inexpensive kind of wood. The surface layer 32 may have a thickness of 3–4 mm and consist of a decorative kind of hardwood and be varnished. The balancing layer 34 of the rear side may consist of a 2 mm veneer layer. In some cases, it may be advantageous to use different types of wood materials in different parts of the floorboard for optimal properties within the individual parts of the floorboard.

As mentioned above, the mechanical locking system according to the invention comprises a tongue groove 36 in one joint edge portion 4*a* of the floorboard, and a tongue 38 on the opposite joint edge portion 4*b* of the floorboard.

The tongue groove 36 is defined by upper and lower lips 39, 40 and has the form of an undercut groove with an opening between the two lips 39, 40.

The different parts of the tongue groove 36 are best seen in FIG. 11*b*. The tongue groove is formed in the core or core 30 and extends from the edge of the floorboard. Above the tongue groove, there is an upper edge portion or joint edge surface 41 which extends up to the surface plane HP. Inside the opening of the tongue groove, there is an upper engaging or supporting surface 43 which in this case is parallel with the surface plane HP. This engaging or supporting surface passes into an inclined locking surface 43 which has a locking angle A to the horizontal plane HP. Inside the locking surface, there is surface portion 46 which forms the upper boundary surface of the undercut portion 35 of the tongue groove. The tongue groove further has a bottom end 48 which extends down to the lower lip 40. On the upper side of this lip there is an engaging or supporting surface 50. The outer end of the lower lip has a joint edge surface 52 which is positioned at a distance from the joint plane VP.

The shape of the tongue is also best seen in FIG. 11*b*. The tongue is made of the material of the core or core 30 and extends beyond the joint plane VP when this joint edge portion 4*b* is mechanically joined with the joint edge portion 4*a* of an adjoining floorboard. The joint edge portion 4*b* also has an upper edge portion or upper joint edge surface 61 which extends along the joint plane VP down to the root of the tongue 38. The upper side of the root of the tongue has an upper engaging or supporting surface 64 which in this case extends to an inclined locking surface 65 of an upwardly directed portion 8 close to the tip of the tongue. The locking surface 65 passes into a guiding surface portion 66 which ends in an upper surface 67 of the upwardly directed portion 8 of the tongue. After the surface 67 follows a bevel which may serve as a guiding surface 68. This extends to the tip 69 of the tongue. At the lower end of the tip 69 there is a further guiding surface 70 which extends obliquely downwards to the lower edge of the tongue and an engaging or supporting surface 71. The supporting surface 71 is intended to coact with the supporting surface 50 of the lower lip when two such floorboards are mechanically joined, so that their upper sides are positioned in the same surface plane HP and meet at a joint plane VP directed perpendicular thereto, so that the upper joint edge surface 41, 61 of the boards engage each other. The tongue has a lower joint edge surface 72 which extends to the underside.

Figure 1A:
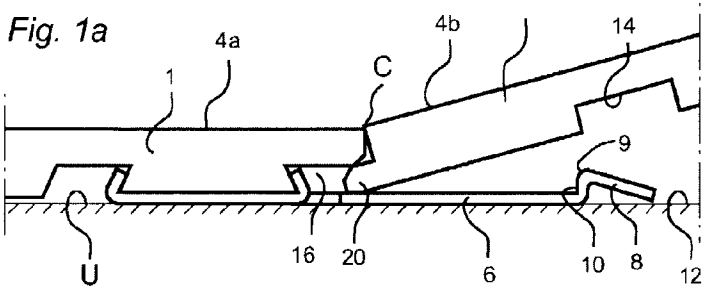
FIGS. 1*a–c* show in three steps a downward angling method for mechanical joining of long sides of floorboards according to WO 9426999.
Figure 1B:
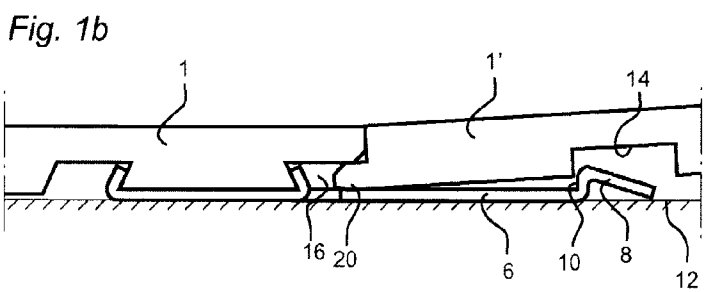
Figure 1C:
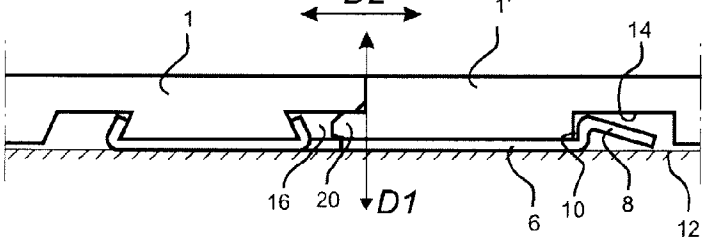
Figure 2A:
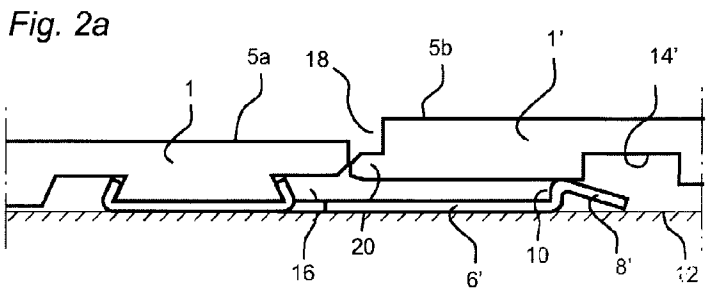
FIGS. 2*a–c* show in three steps a snapping-in method for mechanical joining of short sides of floorboards according to WO 9426999.
Figure 2B:
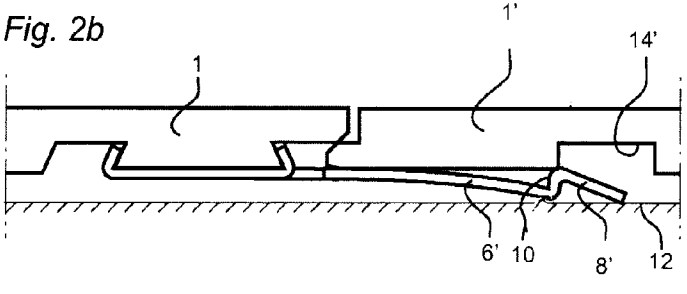
Figure 2C:
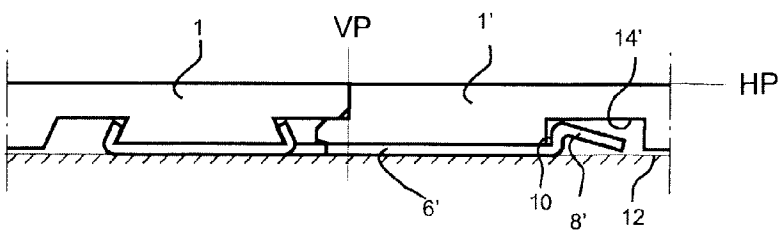
Figure 3A:
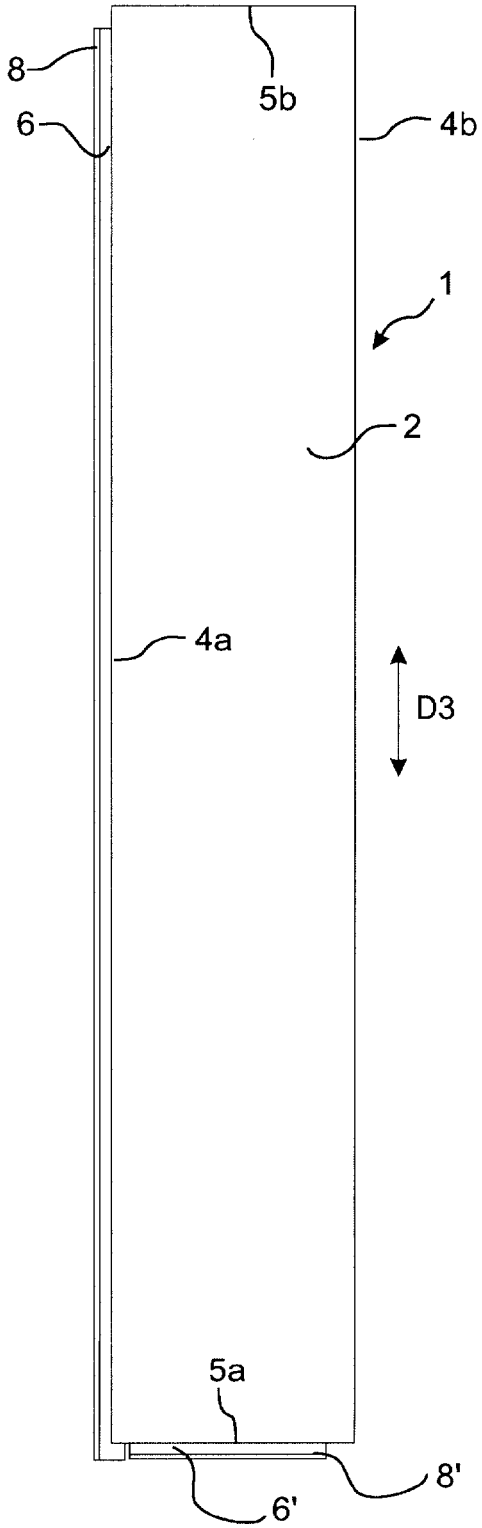
FIGS. 3*a–b* show a floorboard according to WO 9426999 seen from above and from below respectively.
Figure 3B:
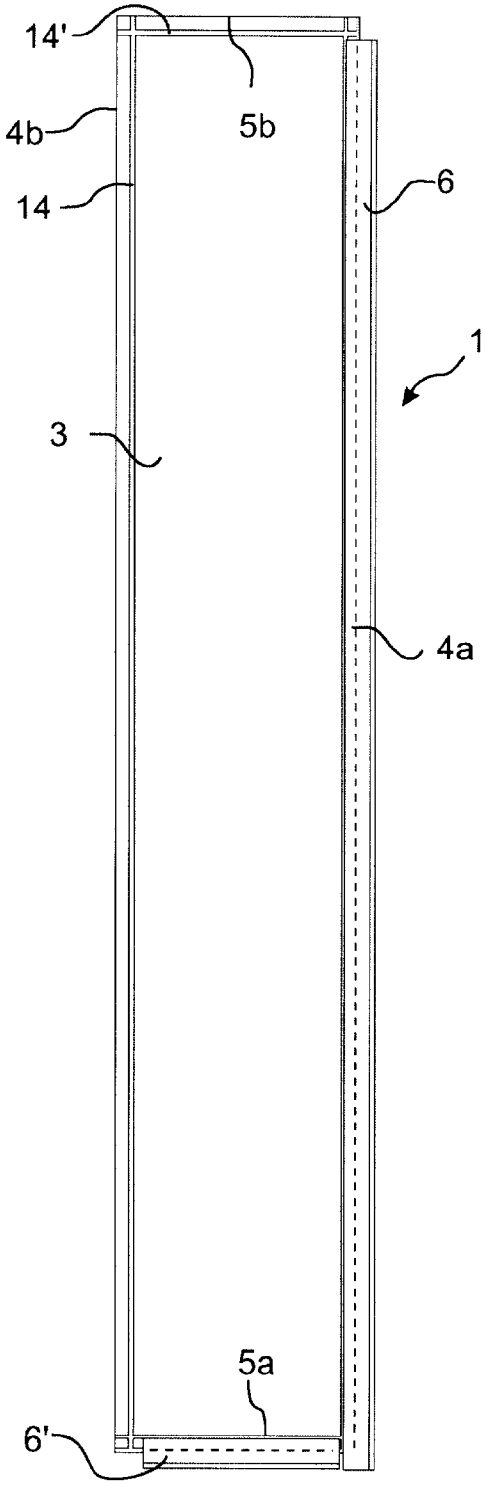

In this embodiment there are separate engaging or supporting surface 43, 64 in the tongue groove and on the tongue, respectively, which in the locked state engage each other and coact with the lower supporting surfaces 50, 71 on the lower lip and on the tongue, respectively, to provide the locking in the direction D1 perpendicular to the surface plane HP. In other embodiments, which will be described below, use is made of the locking surfaces 45, 65 both as locking surfaces for locking together in the direction D2 parallel with the surface plane HP and as supporting surfaces for counteracting movements in the direction D1 perpendicular to the surface plane. In the embodiment according to FIGS. 21*a*, 2*b*, the locking surfaces 45, 65 and the engaging surfaces 43, 64 coact as upper supporting surfaces in the system.

As is apparent from the drawing, the tongue 38 extends beyond the joint plane VP and has an upwardly directed portion 8 at its free outer end or tip 69. The tongue has also a locking surface 65 which is formed to coact with the inner locking surface 45 in the tongue groove 36 of an adjoining floorboard when two such floorboards are mechanically joined, so that their front sides are positioned in the same surface plane HP and meet at a joint plane VP directed perpendicular thereto.

As is evident from FIG. 11*b*, the tongue 38 has a surface portion 52 between the locking surface 51 and the joint plane VP. When two floorboards are joined, the surface portion 52 engages the surface portion 45 of the upper lip 8. To facilitate insertion of the tongue into the undercut groove by inward angling or snapping-in, the tongue can, as shown in FIGS. 11*a*, 11*b*, have a bevel 66 between the locking surface 65 and the surface portion 57. Moreover, a bevel 68 can be positioned between the surface portion 57 and the tip 69 of the tongue. The bevel 66 may serve as a guiding part by having a lower angle of inclination to the surface plane than the angle of inclination A of the locking surfaces 43, 51.

The supporting surface 71 of the tongue is in this embodiment essentially parallel with the surface plane HP. The tongue has a bevel 70 between this supporting surface and the tip 69 of the tongue.

According to the invention, the lower lip 40 has a supporting surface 50 for coaction with the corresponding supporting surface 71 on the tongue 36. In this embodiment, this supporting surface is positioned at a distance from the bottom end 48 of the undercut groove. When two floorboards are joined with each other, there is engagement both between the supporting surfaces 50, 71 and between the engaging or supporting surface 43 of the upper lip 39 and the corresponding engaging or supporting surface 64 of the tongue. In this way, locking of the boards in the direction D1 perpendicular to the surface plane HP is obtained.

Preferably, at least the major part of the bottom end 48 of the undercut groove, seen parallel with the surface plane HP, is located further away from the joint plane VP than is the outer end or tip 69 of the tongue 36. By this design, manufacture is simplified to a considerable extent, and displacement of one floorboard relative to another along the joint plane is facilitated.

Another important feature of a mechanical locking system according to the invention is that all parts of the portions of the lower lip 40 which are connected with the core 30, seen from the point C, where the surface plane HP and the joint plane VP intersect, are located outside a plane LP2. This plane is located further away from said point C than a locking plane LP1 which is parallel with the plane LP2 and which is tangent to the coacting locking surfaces 45, 65 of the undercut groove 36 and the tongue 38, where these locking surfaces are most inclined relative to the surface plane HP. Owing to this design, the undercut groove can, as will be described in more detail below, be made by using large disk-shaped rotating cutting tools for machining of the edge portions of the floorboards.

A further important feature is that the lower lip 40 is resilient and that it is shorter than the upper lip 39. This enables production of the undercut using large rotating cutting tools which can be set at a relatively high angle to the horizontal plane, so that the locking surface 65 can be made with a high locking angle A. The high locking angle significantly reduces the downward component that arises in connection with tensile load. This means that the joint system will have high strength although the lower lip is resilient and thus has a limited capability of counteracting a downward component. This results in optimization for obtaining a high locking force in combination with lower resistance to snapping-in. High resistance to snapping-in makes snapping-in difficult and increases the risk of damage to the joint edge portions of the floorboards. The inventor has found that most materials used in floorboards can be made sufficiently resilient by being formed with lips of a suitable thickness and length which can work in the preferred joint system and provide sufficient locking force.

Figure 12A:
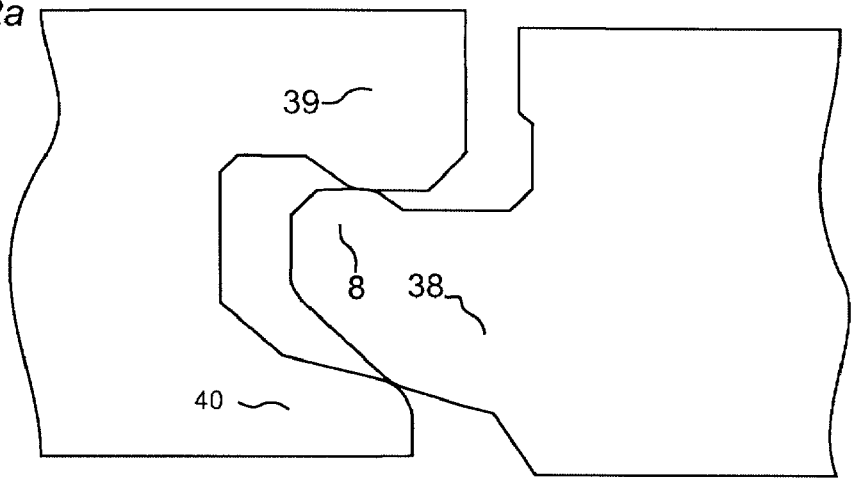
FIGS. 12*a–c* show snapping-in of a variant of the invention.
Figure 12B:
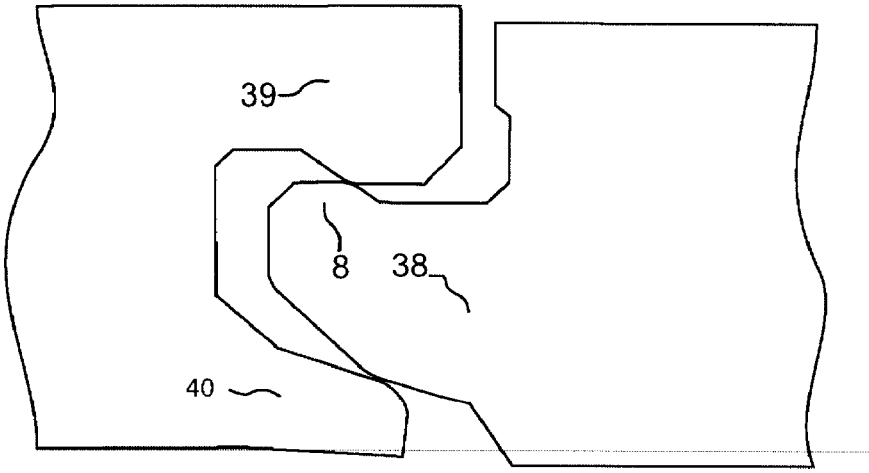
Figure 12C:
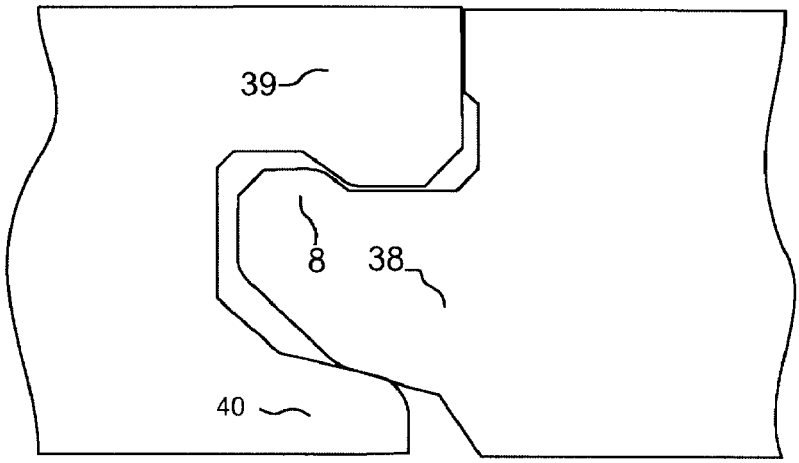

FIGS. 12*a–c* show snapping-in of two floorboards by bending of the lower lip 40. As is evident from FIG. 12*b,* snapping-in takes place with a minimum bending of the lower lip and with the surface planes of the floorboards on essentially the same level. This reduces the risk of cracking.

Figure 13A:
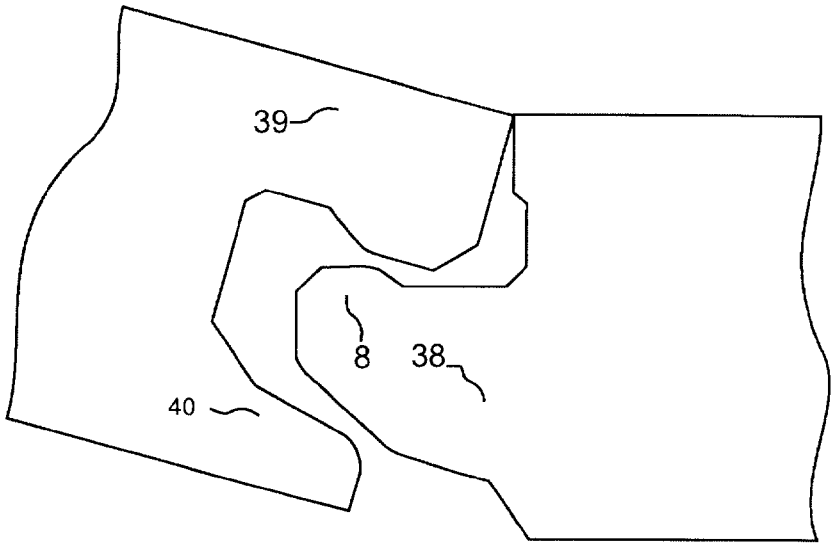
FIGS. 13*a–c* show a downward and upward angling method using the invention.
Figure 13B:
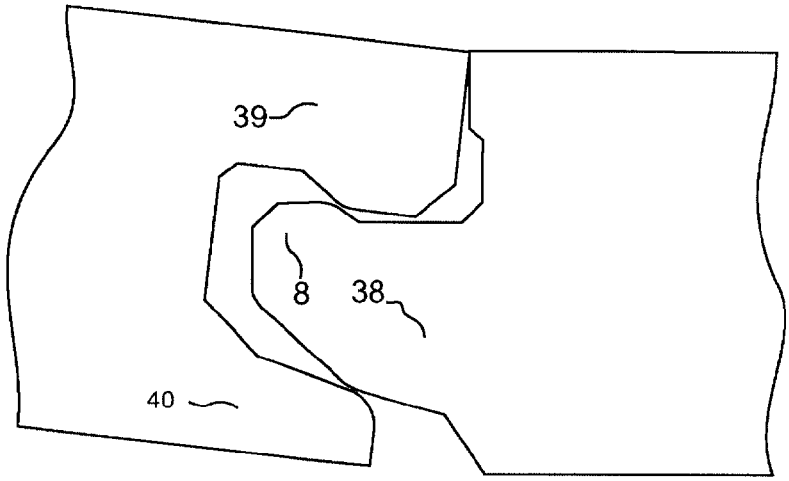
Figure 13C:
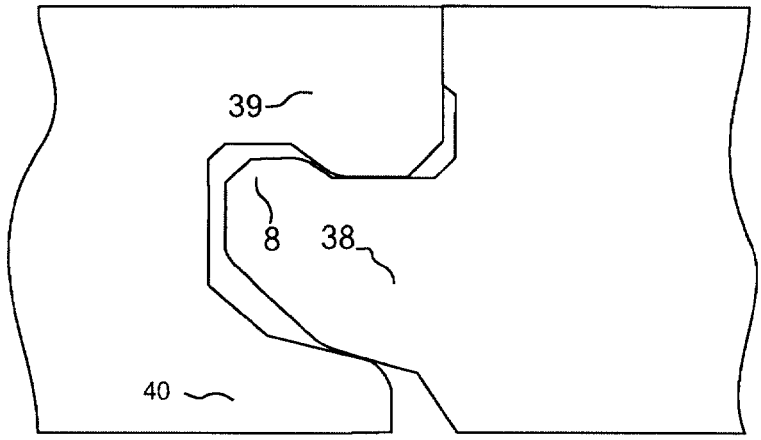

FIGS. 13*a–c* show that the locking system according to FIGS. 12*a–c* can also be used for upward angling and downward angling in connection with taking-up and laying. The upper and lower lips 39, 40 and the tongue 38 are formed to enable disconnection of two mechanically joined floorboards by one floorboard being pivoted upwards relative to the other about a pivoting center close to the intersection C between the surface plane HP and the joint plane VP so that the tongue of this floorboard is pivoted out of the undercut groove of the other floorboard.

The snap joint according to the invention can be used on both long side and short side of the floorboards.

Figure 14:
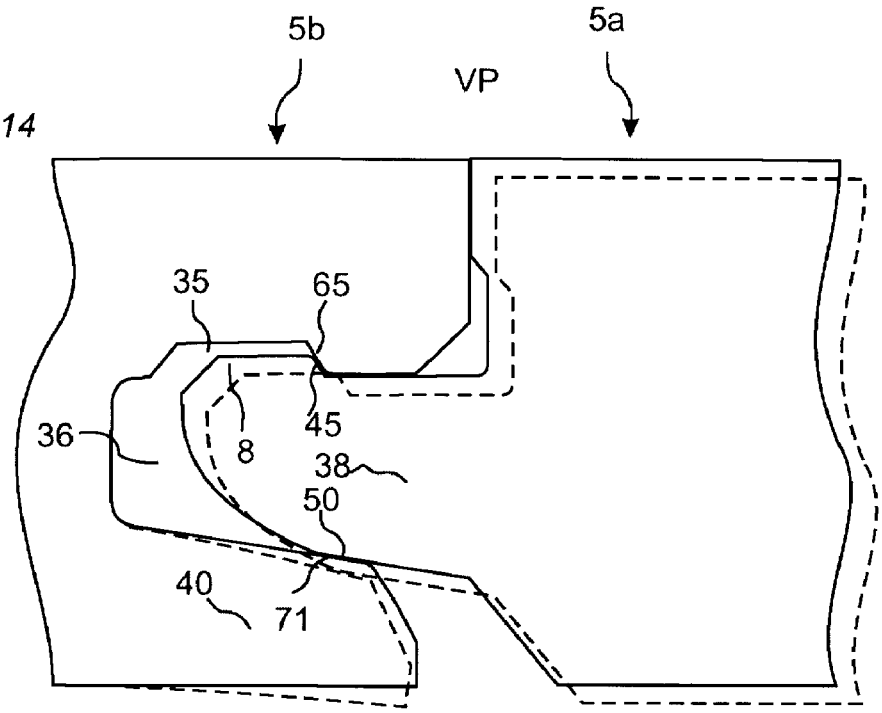
FIG. 14 shows snapping-in of a production-adapted variant of the invention.
Figure 15:
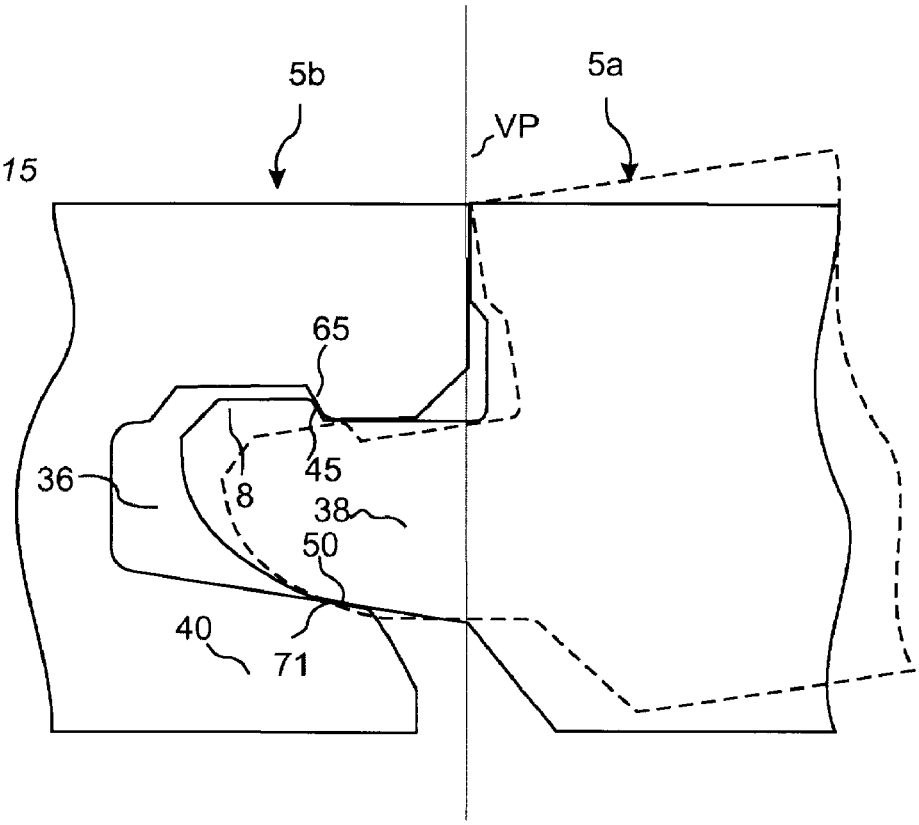
FIG. 15 shows this variant of the invention to illustrate taking-up by upward angling while using bending and compression in the joint material.

FIG. 14 and FIG. 15 show, however, a variant of the invention which is above all suited for snapping along the short side of a floorboard which is made of a relatively hard material, such as a hard kind of wood or a hard fiberboard.

In this embodiment, the tongue groove is essentially deeper than is required to receive the tongue. As a result, a higher bendability of the lower lip 40 is obtained. Moreover, the locking system has a long tongue with a thick locking element 8. The locking surfaces 45, 65 are also heavily inclined. The dashed line indicates the snapping motion.

The design according to FIGS. 14 and 15 allow disconnection by upward angling of one board and a slight downward bending of the lower lip 40 of the other board. However, in other more preferred embodiments of the invention, no downward bending of the lower lip is necessary when disconnecting the floorboards.

In the locked position, it is possible to displace the floorboards in the longitudinal direction of the joint. As a result, disconnection of, for example, the short sides can take place by pulling out in the longitudinal direction of the joint after disconnection of the long sides by, for instance, upward angling.

To facilitate manufacture, inward angling, upward angling, snapping-in and displaceability in the locked position and to minimize the risk of creaking, all surfaces that are not operative to form a joint with tight upper joint edges and the vertical and horizontal joint should be formed so as not to be in contact with each other in the locked position and preferably also during locking and unlocking. This allows manufacture without requiring high tolerances in these joint portions and reduces the friction in lateral displacement along the joint edge. Examples of surfaces or parts of the joint system that should not be in contact with each other in the locked position are 46–67, 48–69, 50–70 and 52–72.

The joint system according to the preferred embodiment may consist of several combinations of materials. The upper lip 39 can be made of a rigid and hard upper surface layer 32 and a softer lower part which is part of the core 30. The lower lip 40 can consist of the same softer upper part 30 and also a lower soft part 34 which can be another kind of wood. The directions of the fibers in the three kinds of wood may vary. This can be used to provide a joint system which utilizes these material properties. The locking element is therefore according to the invention positioned closer to the upper hard and rigid part, which thus is flexible and compressible to a limited extent only, while the snap function is formed in the softer lower and flexible part. It should be pointed that the joint system can also be made in a homogeneous floorboard.

Figures 16A, 16B, 16C:
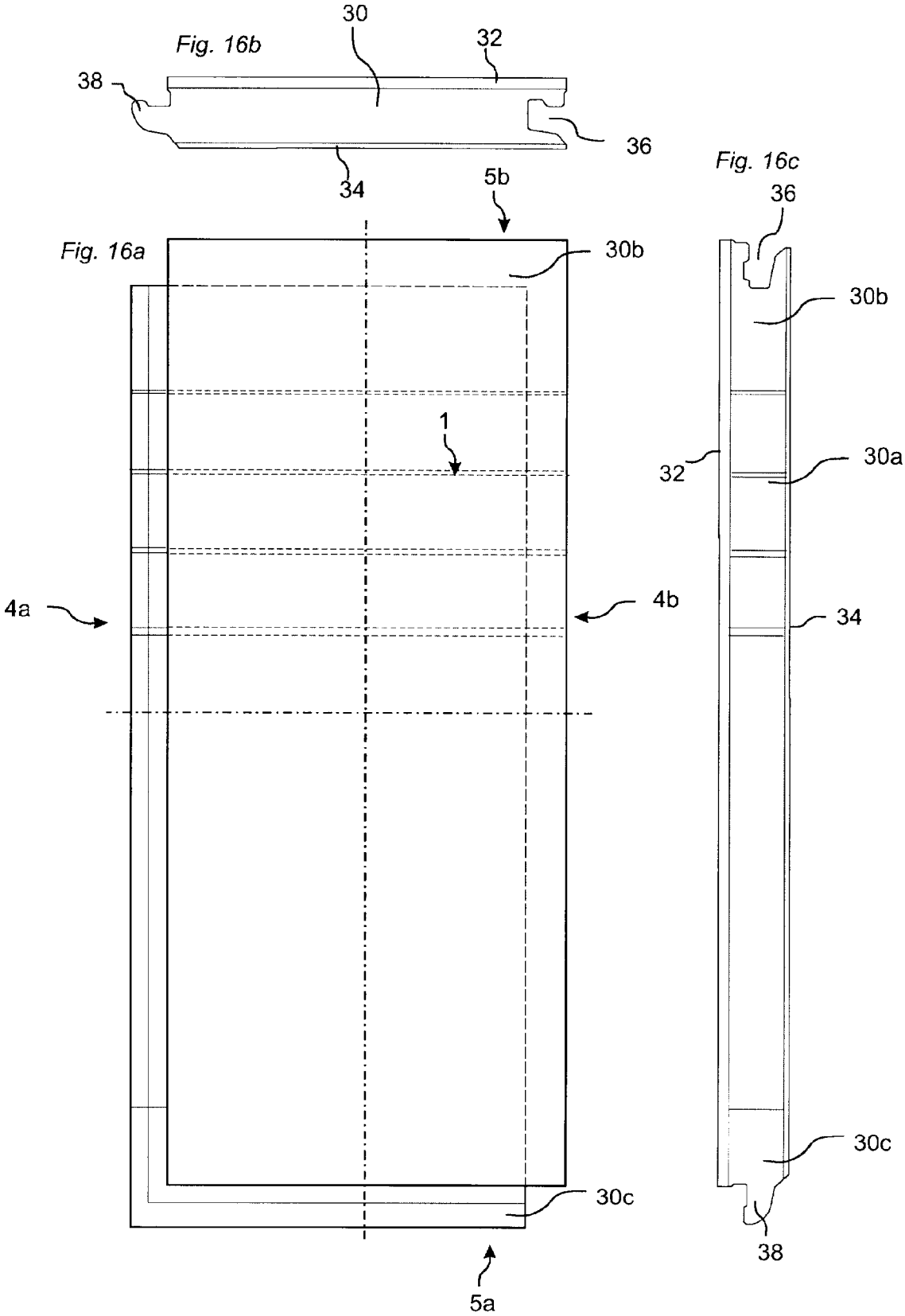
FIGS. 16*a–c* show examples of a floorboard according to the invention.

FIGS. 16*a–c* illustrate an example of a floorboard according to the invention. This embodiment shows specifically that the joint system on long side and short side is differently designed. On the short side, the locking system is optimized for snapping by means of a high locking angle, deep tongue groove and upper lip shorter than lower lip while at the same time the locking surfaces have a low height to reduce the requirement for downward bending. On the long side, the joint system has been adjusted for joining/taking-up by angular motions.

Moreover, the joint system may consist of different materials and combinations of materials 30*a,* 30*b* and 30*c*. It is also possible to select different materials on long and short sides. For example, the groove part 36 of the short sides may consist of a harder and more flexible wood material than, for instance, the tongue part 38 which can be hard and rigid and have other properties than the core of the long side. On the short side with the tongue groove 36 it is possible, for instance, to choose a kind of wood 30*b* which is more flexible than the kind of wood 30*c* on the other short side where the tongue is formed. This is particularly convenient in parquet floors with a lamellar core where the upper and lower side consist of different kinds of wood and the core consists of glued blocks. This construction gives great possibilities of varying the composition of materials to optimize function, strength and production cost.

It is also possible to vary the material along the length of a side. Thus, for instance the blocks that are positioned between the two short sides can be of different kinds of wood or materials so that some can be selected with regard to their contributing suitable properties which improve laying, strength etc. Different properties can also be achieved with different orientation of fibers on long side and short side, and also plastic materials can be used on the short sides and, for instance, on different parts of the long side. If the floorboard or parts of its core consist of e.g. plywood with several layers, these layers can be selected so that the upper lip, the tongue and the lower lip on both long side and short side can all have parts with different composition of materials, orientation of fibers etc. which may give different properties as regards strength, bendability, machinability etc.

Figure 17A:
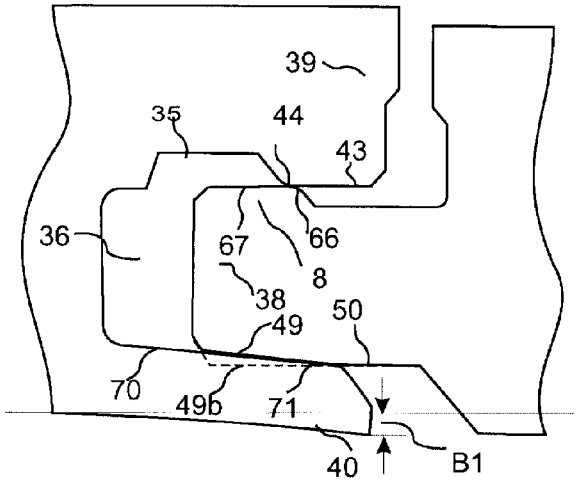
Figure 17B:
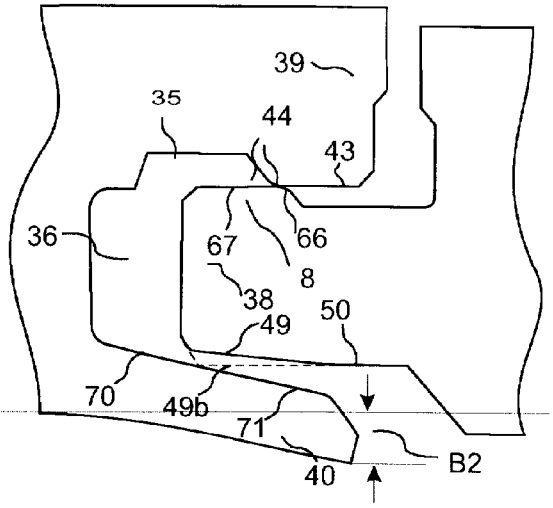
Figure 17C:
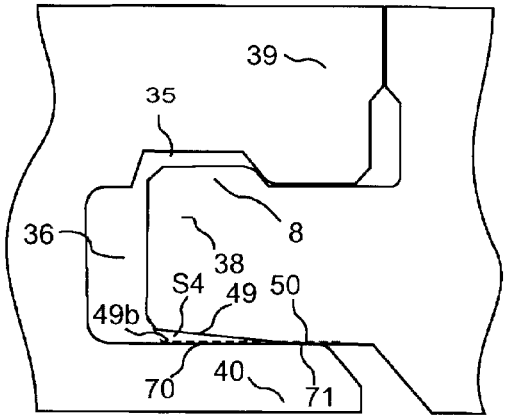

FIGS. 17*a–c* show the basic principle of how the lower part of the tongue should be designed in relation to the lower lip 40 so as to facilitate a horizontal snapping-in according to the invention in a joint system with an undercut or locking groove 8 in a rigid upper lip 39 and with a flexible lower lip 40. In this embodiment, the upper lip 39 is significantly more rigid, among other things owing to the fact that it can be thicker or that it may consist of harder and more rigid materials. The lower lip 40 can be thinner and softer and the essential bending will therefore, in connection with snapping-in, take place in the lower lip 40. Snapping-in can be significantly facilitated among other things by the maximum bending of the lower lip 40 being limited as far as possible. FIG. 17*a* shows that the bending of the lower lip 40 will increase to a maximum bending level B1 which is characterized in that the tongue 38 is inserted so far into the tongue groove 36 that the rounded guiding parts come into contact with each other. When the tongue 38 is inserted still more, the lower lip 40 will be bent back until the snapping-in is terminated and the locking element 8 is fully inserted in its final position in the undercut 35. The lower and front part 49 of the tongue 38 should be designed so as not to bend down the lower lip 40 which instead should be forced downward by the lower supporting surface 50. This part 49 of the tongue should have a shape which either touches or goes clear of the maximum bending level of the lower lip 40 when this lower lip 40 is bent along the outer part of the lower engaging surface 50 of the tongue 38. If the tongue 38 has a shape which in this position overlaps the lower lip 40, indicated by the dashed line 49*b,* the bending B2 according to FIG. 17*b* can be significantly greater. This may result in high friction in connection with snapping-in and a risk of the joint being damaged. FIG. 17*c* shows that the maximum bending can be limited by the tongue groove 36 and the tongue 38 being designed so that there is a space S4 between the lower and outer part 49 of the tongue and the lower lip 40. The upper lip being made more rigid and the lower lip more flexible reduces the risk of edge rising on the upper side of the laid floor as the floor shrinks and swells depending on the relative humidity of the indoor air. The greater rigidity of the upper lip in combination with the arrangement of the locking surfaces also makes it possible for the joint to take up great pulling-apart forces transversely of the joint. Also the bending away of the lower lip contributes to minimizing the risk of edge rising.

Figure 18:
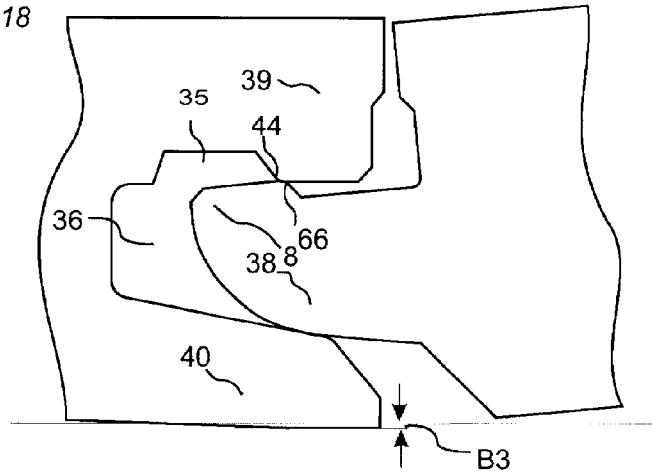
FIG. 18 shows snapping-in in an angled position.

Horizontal snapping-in is normally used in connection with snapping-in of the short side after locking of the long side. When snapping-in the long side, it is also possible to snap the joint system according to the invention with one board in a slightly upwardly angled position. This upwardly angled snap position is illustrated in FIG. 18. Only a small degree of bending B3 of the lower lip 40 is necessary for the guiding part 66 of the locking element to come into contact with the guiding part 44 of the locking groove so that the locking element can then by downward angling be inserted into the undercut 35.

Figure 19:
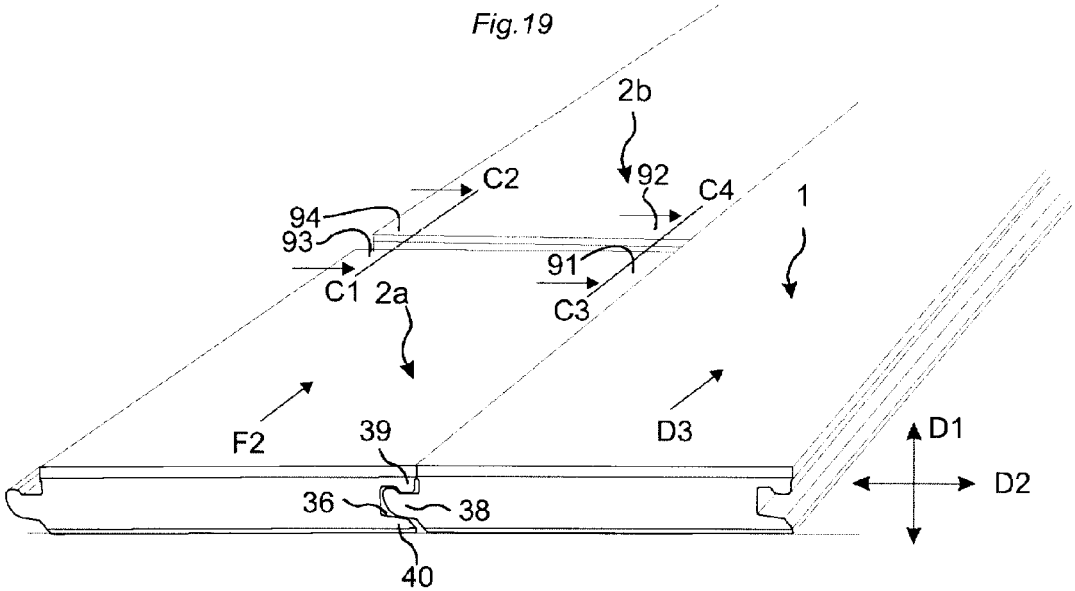
Figure 20A:
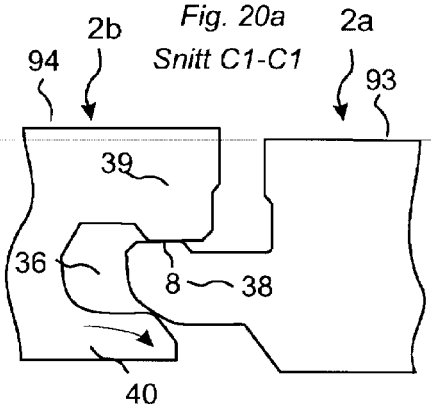
FIGS. 20*a–b* show snapping-in of the outer and inner corner portion of the short side.
Figure 20B:
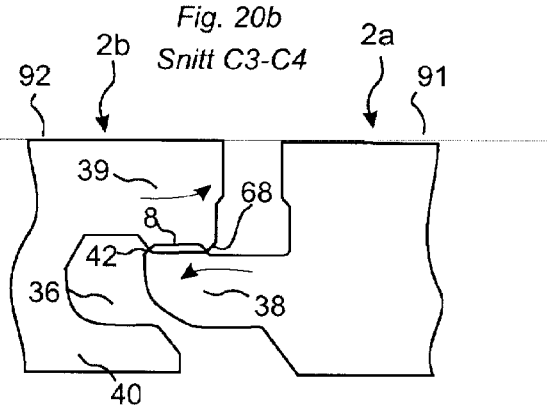

FIGS. 19 and 20 also describe a problem which can arise in connection with snapping-in of two short sides of two boards 2*a* and 2*b* which are already joined on their long sides with another first board 1. When the floorboard 2*a* is to be joined with the floorboard 2*b* by snap action, the inner corner portions 91 and 92, closest to the long side of the first board 1, are positioned in the same plane. This is due to the fact that the two boards 2*a* and 2*b* on their respective long sides are joined to the same floorboard 1. According to FIG. 20*b,* which shows the section C3–C4, the tongue 38 cannot be inserted into the tongue groove 39 to begin the downward bending of the lower lip 40. In the outer corner portions 93, 94 on the other long side, in the section C3–C4 shown in FIG. 20*a,* the tongue 38 can be inserted into the tongue groove 36 to begin the downward bending of the lower lip 40 by the board 2*b* being automatically pressed and angled upwards corresponding to the height of the locking element 8.

The inventor has thus discovered that there may be problems in connection with snapping-in of inner corner portions in lateral displacement in the same plane when the tongue is formed with an upwardly directed portion at its tip and is to be inserted into a tongue groove with an undercut. These problems may cause a high resistance to snapping-in and a risk of cracking in the joint system. The problem can be solved by a suitable joint design and choice of materials which enable material deformation and bending in a plurality of joint portions.

When snapping-in such a specially designed joint system, the following takes place. In lateral displacement, the outer guiding parts 42, 68 of the tongue and the upper lip coact and force the upwardly directed portion or locking element 8 of the tongue under the outer part of the upper lip 39. The tongue bends downward and the upper lip bends upward. This is indicated by arrows in FIG. 20*b*. The corner portion 92 in FIG. 19 is pressed upward by the lower lip 40 on the long side of the board 2*b* being bent and the corner portion 91 being pressed downward by the upper lip on the long side of the board 2*a* being bent upward. The joint system should be constructed so that the sum of these four deformations is so great that the locking element can slide along the upper lip and snap into the undercut 35. It is known that it should be possible for the tongue groove 36 to widen in connection with snapping-in. However, it is not known that it may be an advantage if the tongue, which normally should be rigid, should also be designed so as to be able to bend in connection with snapping-in.

Figure 21:
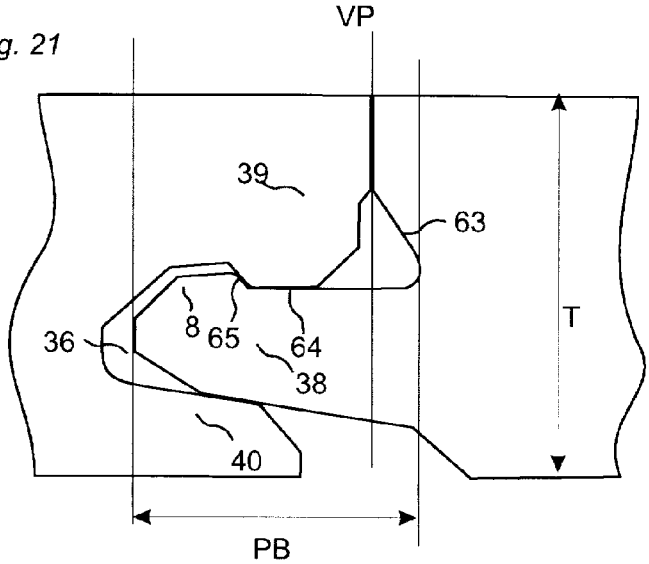
FIG. 21 shows a joint system according to the invention with a flexible tongue.

Such an embodiment is shown in FIG. 21. A groove or the like 63 is made at the upper and inner part of the tongue inside the vertical plane VP. The entire extent PB of the tongue from its inner part to its outer part can be extended, and it can, for instance, be made greater than half the floor thickness T.

FIGS. 22 and 23 show how the parts of the joint system bend in connection with snapping-in at the inner corner portion 91, 92 (FIG. 19) and the outer corner portion 93, 94 (FIG. 19) of two floorboards 2*a* and 2*b*. To simplify manufacture, it is required that only the thin lip and the tongue bend. In practice, of course all parts that are subjected to pressure will be compressed and bent to a varying degree depending on thickness, bendability, composition of materials etc.

Figure 22A:
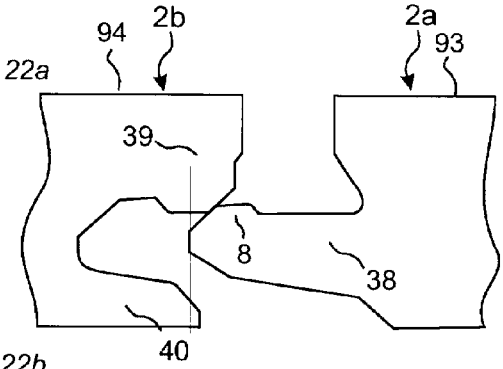
FIGS. 22*a–e* show in detail snapping-in of the outer corner portion of the short side by using an embodiment of the invention.
Figure 23A:
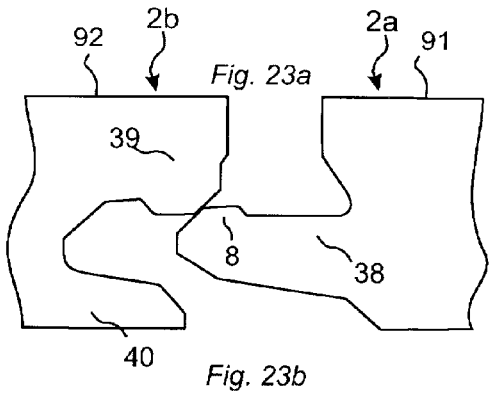
FIGS. 23*a–e* illustrate in detail snapping-in of the inner corner portion of the short side by using an embodiment of the invention.

FIG. 22*a* shows the outer corner portion 93, 94 and FIG. 23*a* shows the inner corner portion 91, 92. These two Figures show the position when the edges of the boards come into contact with each other. The joint system is designed so that even in this position the outermost tip of the tongue 38 is located inside the outer part of the lower lip 40.

Figure 22B:
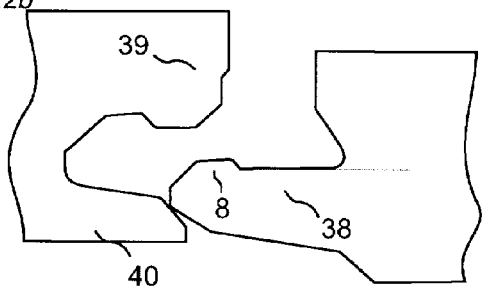
Figure 23B:
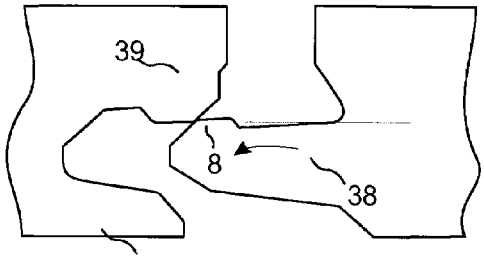
Figure 22C:
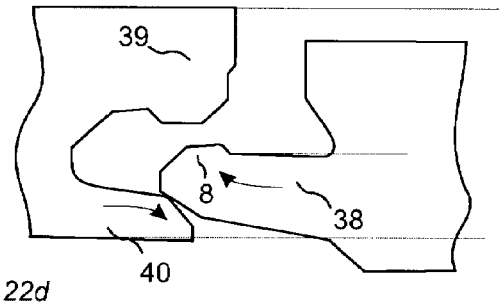
Figure 23C:
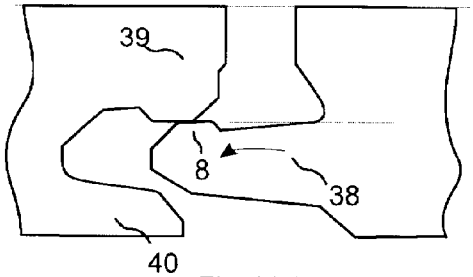
Figure 22D:
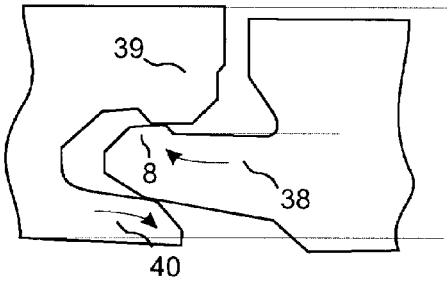
Figure 23D:
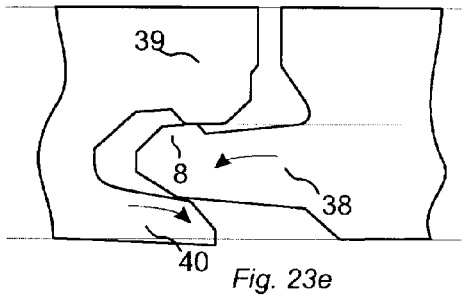
Figure 22E:
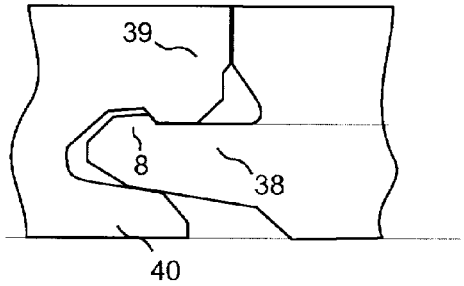
Figure 23E:
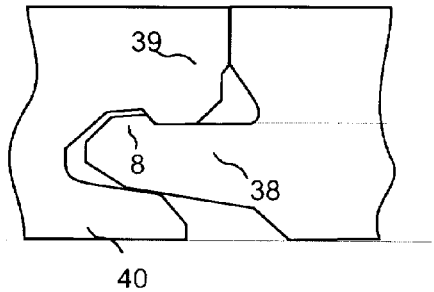

When the boards are pushed towards each other still more, the tongue 38 will in the inner corner 91, 92 press the board 2*b* upward according to FIGS. 22*b,* 23*b.* The tongue will bend downward and the board 2*b* at the outer corner portion 93, 94 will be angled upward. FIG. 23*c* shows that the tongue 38 at the inner corner 91, 92 will be bent downward. At the outer corner 93, 94 according to FIG. 22*c,* the tongue 38 is bent upward and the lower lip 40 downward. According to FIGS. 22*d,* 23*d,* this bending continues as the boards are pushed towards each other still more and now also the lower lip 40 is bent at the inner corner 91, 92 according to FIG. 23*d.* FIGS. 22*d,* 23*e* show the snapped-in position. Thus, snapping-in can be facilitated significantly if the tongue 38 is also flexible and if the outer part of the tongue 38 is positioned inside the outer part of the lower lip 40 when tongue and groove come into contact with each other when the boards are positioned in the same plane in connection with snapping-in that takes place after locking of the floorboard along its two other sides.

Several variants can exist within the scope of the invention. The inventor has manufactured and evaluated a large number of variants where the different parts of the joint system have been manufactured with different widths, lengths, thicknesses, angles and radii of a number of different board materials and of homogeneous plastic and wooden panels. All joint systems have been tested in a position turned upside-down and with snapping and angling of groove and tongue boards relative to each other and with different combinations of the systems here described and also prior-art systems on long side and short side. Locking systems have been manufactured where locking surfaces are also upper engaging surfaces, where the tongue and groove have had a plurality of locking elements and locking grooves, and where also the lower lip and the lower part of the tongue have been formed with horizontal locking means in the form of locking element and locking groove.

What I claim and desire to secure by Letters Patent is:

1. A locking system for mechanical joining of floorboards at a joint plane, said floorboards having a core, a front side, a rear side and opposite joint edge portions, of which one is formed as a tongue groove, which is defined by upper and lower lips and has a bottom end, and the other is formed as a tongue with an upwardly directed portion at its free outer end, the tongue groove, seen from the joint plane, having the shape of an undercut groove with an opening, an inner portion and an inner locking surface, and at least parts of the lower lip being formed integrally with the core of the floorboard, and the tongue having a locking surface which is formed to coact with the inner locking surface in the tongue groove of an adjoining floorboard, when two such floorboards are mechanically joined, so that their front sides are positioned in the same surface plane and meet at the joint plane directed perpendicular thereto, wherein the inner locking surface of the tongue groove is formed on the upper lip within the undercut portion of the tongue groove for coaction with the corresponding locking surface of the tongue, said locking surface being formed on the upwardly directed portion of the tongue to counteract pulling-apart of two mechanically joined boards in a direction perpendicular to the joint plane, the lower lip has a supporting surface for coaction with a corresponding supporting surface on the tongue, said supporting surfaces being intended to coact to counteract a relative displacement of two mechanically joined boards in a direction perpendicular to the surface plane, all parts of the portions of the lower lip which are connected with the core, seen from the point where the surface plane and the joint plane intersect, are located outside a plane which is positioned further away from said point than a locking plane which is parallel therewith and which is tangent to the coacting locking surfaces of the tongue groove and the tongue where these are most inclined relative to the surface plane and all parts of the portions of the lower lip which are connected with the core are shorter than the upper lip and terminate at a distance from the joint plane, the lower lip is flexible, and the upper and lower lips of the joint edge portions are formed to enable connection of a laid floorboard with a new floorboard by a pushing-together motion essentially parallel with the surface plane of the laid floorboard for snapping together the parts of the locking system during downward bending of the lower lip of the tongue groove.

2. The locking system as claimed in claim 1, wherein the upper lip is more rigid than the lower lip.

3. The locking system as claimed in claim 1, wherein the tongue is flexible.

4. The locking system as claimed in claim 1, wherein the joint edge portions are designed to enable connection of a laid floorboard with a new floorboard by a pushing-together motion with the surface plane of the floorboards essentially aligned with each other during bending of the tongue and the lower lip.

5. The locking system as claimed in claim 1, wherein the upper and lower lips of the joint edges are designed to enable disconnection of two mechanically joined floor-boards by upward pivoting of one floorboard relative to the other about a pivoting center close to a point of intersection between the surface plane and the joint plane for disconnecting the tongue of the one floorboard from the tongue groove of the other floorboard.

6. The locking system as claimed in claim 5, wherein the upper and lower lips of the joint edges are designed to enable disconnection of two mechanically joined floorboards by upward pivoting of one floorboard relative to the other about a pivoting center close to a point of intersection between the surface plane and the joint plane for disconnecting the tongue of one floorboard from the tongue groove of the other floorboard during downward bending of the lower lip.

7. The locking system as claimed in claim 1, wherein at least the major part of the bottom end of the tongue groove, seen parallel with the surface plane, is located further away from the joint plane than is the outer end of the tongue.

8. The locking system as claimed in claim 1, wherein the supporting surface of the lower lip is positioned at a distance from the bottom end of the undercut groove.

9. The locking system as claimed in claim 1, wherein the supporting surfaces of the tongue and the lower lip, which are designed for coaction, are set at a smaller angle to the surface plane than are the coacting locking surfaces of the upper lip and the tongue.

10. The locking system as claimed in claim 1, wherein the locking surfaces are set at essentially the same angle to the surface plane as a tangent to a circular arc, which is tangent to the locking surfaces engaging each other, at a point closest to the bottom of the undercut groove and which has its center at the point where the surface plane and the joint plane intersect.

11. The locking system as claimed in claim 1, wherein the locking surfaces are set at greater angle to the surface plane than a tangent to a circular arc, which is tangent to the locking surfaces engaging each other at a point closest to the bottom of the undercut groove and which has its center at the point where the surface plane and the joint plane intersect.

12. The locking system as claimed in claim 1, wherein the upper lip and the tongue have contact surfaces which in their locked state coact with each other and which are positioned within an area between the joint plane and the locking surfaces of the tongue and the upper lip, which locking surfaces in the locked state coact with each other.

13. The locking system as claimed in claim 12, wherein the contact surfaces, seen from the coacting locking surfaces of the tongue and the upper lip, are inclined upwards and outwards to the joint plane.

14. The locking system as claimed in claim 12, wherein the contact surfaces are essentially parallel with the surface plane.

15. The locking system as claimed in claim 12, wherein the contact surfaces are essentially plane.

16. The locking system as claimed in claim 1, wherein the undercut groove and the tongue are of such a design that the outer end of the tongue is positioned at a distance from the undercut groove along essentially the entire distance from the locking surfaces of the upper lip and the tongue, which locking surfaces engage each other, to the coacting supporting surfaces of the lower lip and the tongue.

17. The locking system as claimed in claim 16, wherein any surface portions with contact between the outer end of the tongue and the undercut groove have a smaller extent seen in the vertical plane than do the locking surfaces when two such boards are mechanically joined.

18. The locking system as claimed in claim 1, wherein the edge portions with their tongue and tongue groove, respectively, are designed so that, when two floorboards are joined, there is surface contact between the edge portions along at most 30% of the edge surface of the edge portion supporting the tongue, measured from the upper side of the floorboard to its underside.

19. The locking system as claimed in claim 1, wherein the coacting supporting surfaces of the tongue and the lower lip are set at an angle of at least 10° to the surface plane.

20. The locking system as claimed in claim 19, wherein the coacting supporting surfaces of the tongue and the lower lip are set at an angle of at most 30° to the surface plane.

21. The locking system as claimed in claim 20, wherein the coacting supporting surfaces of the tongue and the lower lip are set at an angle at most 20° to the surface plane.

22. The locking system as claimed in claim 1, wherein at least parts of the supporting surfaces of the lower lip and the tongue are positioned at a greater distance from the joint plane than are the inclined locking surfaces of the upper lip and the tongue.

23. The locking system as claimed in claim 1, wherein the undercut groove and the tongue are of such a design that a floorboard which is mechanically joined with a similar floorboard is displaceable in a direction along the joint plane.

24. The locking system as claimed in claim 1, wherein the tongue and the undercut groove are designed to enable disconnection of one board from another by pivoting one board relative to the other while maintaining contact between the boards at a point of the joint edge portions of the boards close to the intersection between the surface plane and the joint plane.

25. The locking system as claimed in claim 24, wherein the tongue and the undercut groove are designed to enable disconnection of boards by pivoting one board relative to another while maintaining contact between the boards at a point of the joint edge portions of the boards close to the intersection between the surface plane and the joint plane without essential contact between the tongue side facing away from the surface plane and the lower lip.

26. The locking system as claimed in claim 1, wherein the distance between the locking plane and the plane parallel therewith, outside which all parts of the lower lip portions connected with the core are located, is at least 10% of the thickness of the floorboard.

27. The locking system as claimed in claim 1, wherein the locking surfaces of the upper lip and the tongue form an angle to the surface plane of below 90° but at least 20°.

28. The locking system as claimed in claim 27, wherein locking surfaces of the upper lip and the tongue form an angle to the surface plane of at least 30°.

29. The locking system as claimed in claim 1, wherein the coacting supporting surfaces of the tongue and the lower lip are directed at an angle to the joint plane which is equal to or smaller than a tangent to a circular arc which is tangent to the supporting surfaces engaging each other at a point closest to the bottom of the undercut groove and which has its center at the point where the surface plane and the joint plane intersect, seen in cross-section through the board.

30. The locking system as claimed in claim 29, wherein the coacting supporting surfaces of the tongue and the lower lip are set at a greater angle to the surface plane than a tangent to a circular arc, which is tangent to the supporting surfaces engaging each other at a point closest to the bottom of the undercut groove and which has its center at the point where the surface plane and the joint plane intersect.

31. The locking system as claimed in claim 1, wherein the supporting surfaces of the tongue and the lower lip, which are designed for coaction, are set at a smaller angle to the surface plane than are the coacting locking surfaces of the upper lip and the tongue.

32. The locking system as claimed in claim 31, wherein the supporting surfaces of the tongue and the lower lip, which are designed for coaction, are inclined in the same direction as but at a smaller angle to the surface plane than are the coacting locking surfaces of the upper lip and the tongue.

33. The locking system as claimed in claim 29, wherein the supporting surfaces form an at least 20° greater angle to the surface plane than do the locking surfaces.

34. The locking system as claimed in claim 33, wherein the supporting surfaces form an at least 20° greater angle to the surface plane than do the locking surfaces.

35. The locking system as claimed in claim 1, wherein the locking surfaces of the upper lip and the tongue are essentially plane within at least the surface portions which are intended to coact with each other when two such boards are joined.

36. The locking system as claimed in claim 35, wherein the tongue has a guiding surface which is positioned outside the locking surface of the tongue, seen from the joint plane, and which has a smaller angle to the surface plane than does this locking surface.

37. The locking system as claimed in claim 1, wherein the upper lip has a guiding surface which is positioned closer to the opening of the tongue groove than is the locking surface of the upper lip and which has a smaller angle to the surface plane than does the locking surface of the upper lip.

38. The locking system as claimed in claim 1, wherein at least parts of the supporting surfaces of the lower lip and the tongue are positioned at a greater distance from the joint plane than are the inclined locking surfaces of the upper lip and the tongue.

39. The locking system as claimed in claim 1, wherein the locking surface of the tongue is arranged at a distance of at least 0.1 times the thickness of the floorboard from the tip of the tongue.

40. The locking system as claimed in claim 1, wherein the vertical extent of the locking surfaces coacting with each other is smaller than half the vertical extent of the undercut, seen from the joint plane and parallel with the surface plane.

41. The locking system as claimed in claim 1, wherein the locking surfaces, seen in a vertical section through the floorboard, have an extent which is at most 10% of the thickness of the floorboard.

42. The locking system as claimed in claim 1, wherein the length of the tongue, seen perpendicular away from the joint plane, is at least 0.3 times the thickness of the board.

43. The locking system as claimed in claim 1, wherein the joint edge portion supporting the tongue and/or the joint edge portion supporting the tongue groove has/have a recess which is positioned above the tongue and terminates at a distance from the surface plane.

44. The locking system as claimed in claim 1, wherein the undercut groove, seen in the cross-section, has an outer opening portion which tapers inwards in the form of a funnel.

45. The locking system as claimed in claim 44, wherein the upper lip has a bevel at its outer edge positioned furthest away from the surface plane.

46. A locking system as claimed in any one of the preceding claims, characterized in that the tongue, seen in cross-section, has a tip that tapers.

47. A locking system as claimed in any one of the preceding claims, characterized in that the tongue, seen in cross-section, has a split tip with an upper and a lower tongue part.

48. A locking system as claimed in claim 47, characterized in that the upper and lower tongue parts of the tongue are made of different materials with different material properties.

49. The locking system as claimed in claim 1, wherein the tongue groove and the tongue are formed integrally with the floorboard.

50. The locking system as claimed in claim 1, wherein the upper lip is thicker than the lower lip.

51. The locking system as claimed in claim 1, wherein the minimum thickness of the upper lip adjacent to the undercut is greater than the maximum thickness of the lower lip adjacent to the supporting surface.

52. The locking system as claimed in claim 1, wherein the extent of the supporting surfaces is at most 15% of the thickness of the floorboard.

53. The locking system as claimed in claim 1, wherein the vertical extent of the tongue groove between the upper and the lower lip, measured parallel with the joint plane and at the outer end of the supporting surface, is at least 30% of the thickness of the floorboard.

54. The locking system as claimed in claim 1, wherein the depth of the tongue groove, measured from the joint plane, is at least 2% greater than the corresponding extent of the tongue.

55. The locking system as claimed in claim 1, wherein the tongue has other material properties than the upper or lower lip.

56. The locking system as claimed in claim 1, wherein the upper and lower lips are made of materials with different properties.

57. The locking system as claimed in claim 1, wherein the locking system also comprises a second mechanical lock, which is formed of a locking groove which is formed on the underside of the joint edge portion supporting the tongue and extends parallel with the joint plane, and a locking strip which is integrally attached to the joint edge portion of the board under the groove and extends along essentially the entire length of the joint edge portion and has a locking component which projects from the strip and which, when two such boards are mechanically joined, is received in the locking groove of the adjoining board.

58. The locking system as claimed in claim 57, wherein the locking strip projects beyond the joint plane.

59. The locking system as claimed in claim 1, wherein it is formed in a board which has a core of wood-fiber-based material.

60. The locking system as claimed in claim 59, wherein it is formed in a board which has a core of wood.

61. A floorboard having a core, a front side, a rear side and two opposite parallel joint edge portions which are formed as parts of a mechanical locking system and of which one is formed as a tongue groove defined by upper and lower lips and having a bottom end, and the other is formed as a tongue with an upwardly directed portion at its free outer end, the tongue groove, seen from the joint plane, having the shape of an undercut groove with an opening, an inner portion and an inner locking surface, and at least parts of the lower lip being integrally formed with the core of the floorboard, and the tongue having a locking surface which is designed to coact with the inner locking surface in the tongue groove of an adjoining floorboard when two such floorboards are mechanically joined, so that their front sides are positioned in the same surface plane and meet at the joint plane directed perpendicular thereto, wherein the inner locking surface of the tongue groove is formed on the upper lip within the undercut portion of the tongue groove for coaction with the corresponding locking surface of the tongue, which is formed on the upwardly directed portion of the tongue to counteract pulling apart of two mechanically joined boards in a direction perpendicular to the joint plane, the lower lip has a supporting surface for coaction with a corresponding supporting surface on the tongue, said supporting surfaces being adapted to coact to counteract a relative displacement of two mechanically joined boards in a direction perpendicular to the surface plane, all parts of the portions of the lower lip, which are connected with the core, seen from the point where the surface plane and the joint plane intersect, are positioned outside a plane which is positioned further away from said point than a locking plane which is parallel therewith and which is tangent to the coacting locking surfaces of the tongue groove and the tongue where these locking surfaces are most inclined relative to the surface plane, and all parts of the portions of the lower lip, which are connected with the core, are shorter than the upper lip and terminate at a distance from the joint plane, the lower lip is flexible, and the upper and lower lips of the joint edge portions are designed to enable connection of a laid floorboard with a new floorboard by a pushing-together motion essentially parallel with the surface plane of the laid floorboard for snapping together the parts of the locking system during downward bending of the lower lip of the tongue groove.

62. The floorboard as claimed in claim 61, wherein the upper lip is more rigid than the lower lip.

63. The floorboard as claimed in claim 61, wherein the tongue is flexible.

64. The floorboard as claimed in claim 61, wherein the joint edge portions are designed to enable connection of a laid floorboard with a new floorboard by a pushing-together motion with the surface planes of the floorboards essentially aligned with each other during bending of the tongue and the lower lip.

65. The floorboard as claimed in claim 61, wherein the upper and lower lips of the joint edges are designed to enable disconnection of two mechanically joined floorboards by upward pivoting of one floorboard relative to the other about a pivoting center close to a point of intersection between the surface plane and the joint plane for disconnecting the tongue of one floorboard from the tongue groove of the other floorboard.

66. The floorboard as claimed in claims 65, wherein the upper and lower lips of the joint edges are designed to enable disconnection of two mechanically joined floorboards by upward pivoting of one floorboard relative to the other about a pivoting center close to a point of intersection between the surface plane and the joint plane for disconnecting the tongue of one floorboard from the tongue groove of the other floorboard during downward bending of the lower lip.

67. The floorboard as claimed in claim 61, wherein at least the major part of the bottom end of the tongue groove, seen parallel with the surface plane, is positioned further away from the joint plane than is the outer end of the tongue.

68. The floorboard as claimed in claim 61, wherein the supporting surface of the lower lip is located at a distance from the bottom end of the undercut groove.

69. The floorboard as claimed in claim 61, wherein the supporting surfaces of the tongue and the lower lip, which are designed for coaction, are set at a smaller angle to the surface plane than are the coacting locking surfaces of the upper lip and the tongue.

70. The floorboard as claimed in claim 61, wherein the locking surfaces are set at essentially the same angle to the surface plane as a tangent to a circular arc which is tangent to the locking surfaces engaging each other at a point closest to the bottom of the undercut groove and which has its center at the point where the surface plane and the joint plane intersect.

71. The floorboard as claimed in claim 61, wherein the locking surfaces are set at a greater angle to the surface plane than a tangent to a circular arc which is tangent to the supporting surfaces engaging each other at a point closest to the bottom of the undercut groove and which has its center at the point where the surface plane and the joint plane intersect.

72. The floorboard as claimed in claim 61, wherein the upper lip and the tongue have contact surfaces which in their locked state coact with each other and which are positioned within an area between the joint plane and the locking surfaces of the tongue and the upper lip, which in their locked state coact with each other.

73. The floorboard as claimed in claim 72, wherein the contact surfaces, seen from the coacting locking surfaces of the tongue and the upper lip, are inclined upwards and outwards to the joint plane.

74. The floorboard as claimed in claim 72, wherein the contact surfaces are essentially parallel with the surface plane.

75. The floorboard as claimed in claim 72, wherein the contact surfaces are essentially plane.

76. The floorboard as claimed in claim 61, wherein the undercut groove and the tongue are of such a design that the outer end of the tongue is located at a distance from the undercut groove along essentially the entire distance from the locking surfaces of the upper lip and the tongue, which engage each other, to the coacting supporting surfaces of the lower lip and the tongue.

77. The floorboard as claimed in claim 76, wherein any surface portions with contact between the outer end of the tongue and the undercut groove have a smaller extent in the vertical plane than do the locking surfaces when two such boards are mechanically joined.

78. The floorboard as claimed in claim 61, wherein the edge portions with their tongue and tongue groove are designed so that when two floorboards are joined, there is surface contact between the edge portions along at most 30% of the edge surface of the edge portion supporting to the tongue, measured from the upper side of the floorboard to its underside.

79. The floorboard as claimed in claim 61, wherein the coacting supporting surfaces of the tongue and the lower lip are set at an angle of at least 10° to the surface plane.

80. The floorboard as claimed in claim 79, wherein the coacting supporting surfaces of the tongue and the lower lip are set at angle of at most 30° to the surface plane.

81. The floorboard as claimed in claim 80, wherein the coacting supporting surfaces of the tongue and the lower lip are set at an angle of at most 20° to the surface plane.

82. The floorboard as claimed in claim 61, wherein at least parts of the supporting surfaces of the lower lip and the tongue are positioned at a greater distance from the joint plane than are the inclined locking surfaces of the upper lip and the tongue.

83. The floorboard as claimed in claim 61, wherein the undercut groove and the tongue are of such a design that a floorboard which is mechanically joined with a similar board is displaceable in a direction along the joint plane.

84. The floorboard as claimed in claim 61, wherein the tongue and the undercut groove are designed to enable disconnection of one board from another by pivoting one board relative to the other while maintaining contact between the boards at a point of the joint edge portions of the boards close to the intersection between the surface plane and the joint plane.

85. The floorboard as claimed in claim 84, wherein the tongue and the undercut groove are designed to enable disconnection of boards by pivoting one board relative to another while maintaining contact between the boards at a point of the joint edge portions of the boards close to the intersection between the surface plane and the joint plane without essential contact between the tongue side facing away from the surface plane and the lower lip.

86. The floorboard as claimed in claim 61, wherein the distance between the locking plane and the plane parallel therewith, outside which all parts of the portions of the lower lip, which are connected with the core, are positioned, is at least 10% of the thickness of the floorboard.

87. The floorboard as claimed in claim 61, wherein the locking surfaces of the upper lip and the tongue form an angle to the surface plane of below 90° but at least 20°.

88. The floorboard as claimed in claim 87, wherein the locking surfaces of the upper lip and the tongue form an angle to the surface plane of at least 30°.

89. The floorboard as claimed in claim 61, wherein the coacting supporting surfaces of the tongue and the lower lip are directed at an angle to the joint plane which is equal to or smaller than a tangent to a circular arc, which is tangent to the supporting surfaces engaging each other at a point closest to the bottom of the undercut groove and which has its center at the point where the surface plane and the joint plane intersect, seen in cross-section through the board.

90. The floorboard as claimed in claim 89, wherein the coacting supporting surfaces of the tongue and the lower lip are set at a greater angle to the surface plane than a tangent to a circular arc, which is tangent to the supporting surfaces engaging each other at a point closest to the bottom of the undercut groove and which has its center at the point where the surface plane and the joint plane intersect.

91. The floorboard as claimed in claim 61, wherein the supporting surfaces of the tongue and the lower lip, which are designed for coaction, are set at a smaller angle to the surface plane than are the coacting locking surfaces of the upper lip and the tongue.

92. The floorboard as claimed in claim 91, wherein the supporting surfaces of the tongue and the lower lip, which are designed for coaction, are inclined in the same direction as but at a smaller angle to the surface plane than are the coacting locking surfaces of the upper lip and the tongue.

93. The floorboard as claimed in claim 89, wherein the supporting surfaces form an at least 20° greater angle to the surface plane than do the locking surfaces.

94. The floorboard as claimed in claim 83, wherein the supporting surfaces form an at least 20° greater angle to the surface plane than do the locking surfaces.

95. The floorboard as claimed in claim 61, wherein the coacting locking surfaces of the upper lip and the tongue are essentially plane within at least the surface portions which are adapted to coact with each other when two such boards are joined.

96. The floorboard as claimed in claim 95, wherein the tongue has a guiding surface which is located outside the locking surface of the tongue, seen from the joint plane, and which has a smaller angle to the surface plane than does this locking surface.

97. The floorboard as claimed in claim 61, wherein the upper lip has a guiding surface which is located closer to the opening of the tongue groove than is the locking surface of the upper lip and which has a smaller angle to the surface plane than does the locking surface of the upper lip.

98. The floorboard as claimed in claim 61, wherein at least parts of the supporting surfaces of the lower lip and the tongue are positioned at a greater distance from the joint plane than are the inclined locking surfaces of the upper lip and the tongue.

99. The floorboard as claimed in claim 61, wherein the locking surface of the tongue is arranged at a distance of at least 0.1 times the thickness of the floorboard from the tip of the tongue.

100. The floorboard as claimed in claim 61, wherein the vertical extent of the locking surfaces coacting with each other is less than half the vertical extent of the undercut, seen from the joint plane and parallel with the surface plane.

101. The floorboard as claimed in claim 61, wherein the locking surfaces, seen in a vertical section through the floorboard, have an extent which is at most 10% of the thickness of the floorboard.

102. The floorboard as claimed in claim 61, wherein the length of the tongue, seen perpendicular away from the joint plane, is at least 0.3 times the thickness of the board.

103. The floorboard as claimed in claim 61, wherein the joint edge portion supporting the tongue and/or the joint edge portion supporting the tongue groove 0.1 has/have a recess which is positioned above the tongue and terminates at a distance from the surface plane.

104. The floorboard as claimed in claim 61, wherein the undercut groove, seen in cross-section, has an outer opening portion which tapers inwards in the form of a funnel.

105. The floorboard as claimed in claim 104, wherein the upper lip has a bevel at its outer edge located furthest away from the surface plane.

106. The floorboard as claimed in claim 61, wherein the tongue, seen in cross-section, has a tip that tapers.

107. The floorboard as claimed in claim 61, wherein the tongue, seen in cross-section, has a split tip with an upper and a lower tongue part.

108. A floorboard as claimed in claim 107, characterized in that the upper and lower tongue parts of the tongue are made of different materials with different material properties.

109. The floorboard as claimed in claim 61, wherein the tongue groove and the tongue are formed integrally with the floorboard.

110. The floorboard as claimed in claim 61, wherein the upper lip is thicker than the lower lip.

111. The floorboard as claimed in claim 61, wherein the minimum thickness of the upper lip adjacent to the undercut is greater than the maximum thickness of the lower lip adjacent to the supporting surface.

112. The floorboard as claimed in claim 61, wherein the extent of the supporting surfaces is at most 15% of the thickness of the floorboard.

113. The floorboard as claimed in claim 61, wherein the vertical extent of the groove between the upper and the lower lip, measured parallel with the joint plane and at the outer end of the supporting surface, is at least 30% of the thickness of the floorboard.

114. The floorboard as claimed in claim 61, wherein the depth of the tongue groove, measured from the joint plane, is at least 2% greater than the corresponding extent of the tongue.

115. The floorboard as claimed in claim 61, wherein the tongue has other material properties than the upper or lower lip.

116. The floorboard as claimed in claim 61, wherein the upper and lower lips are made of materials with different properties.

117. The floorboard as claimed in claim 61, wherein the locking system also comprises a second mechanical lock which is formed of a locking groove which is formed on the underside of the joint edge portion supporting the tongue and extends parallel with the joint plane, and a locking strip which is integrally attached to the joint edge portion of the board under the tongue groove and extends along essentially the entire length of the joint edge portion and has a locking component which projects from the strip and which, when two such boards are mechanically joined, is received in the locking groove of the adjoining board.

118. A floorboard as claimed in claim 117, characterized in that the locking strip projects beyond the joint plane.

119. The floorboard as claimed in claim 61, wherein it is formed in a board which has a core of wood-fiber-based material.

120. The floorboard as claimed in claim 119, wherein it is formed in a board which has a core of wood.

121. The floorboard as claimed in claim 61, wherein it is quadrilateral with sides which are parallel in pairs.

122. A floorboard as claimed in claim 121, characterized in that it has mechanical locking systems at all its four lateral edge portions.

123. A floorboard as claimed in claim 121, wherein the joint edge portion with the tongue and/or the joint edge portion with the tongue groove on one pair of parallel joint edge portions has/have been formed with other material properties than the joint edge portion with the tongue and/or the joint edge portion with the tongue groove on the other pair of parallel joint edge portions.

* * * * *